United States Patent [19]

Ishikawa et al.

[11] Patent Number: 4,966,834

[45] Date of Patent: Oct. 30, 1990

[54] METHOD FOR PROCESSING A SILVER HALIDE COLOR PHOTOGRAPHIC MATERIAL

[75] Inventors: Takatoshi Ishikawa; Shinji Ueda, both of Kanagawa, Japan

[73] Assignee: Fuji Photo Film Co., Ltd., Kanagawa, Japan

[21] Appl. No.: 239,579

[22] Filed: Sep. 1, 1988

[30] Foreign Application Priority Data

Sep. 3, 1987 [JP] Japan ..... 62-219176
Sep. 3, 1987 [JP] Japan ..... 62-220892

[51] Int. Cl.[5] ..... G03C 7/30; G03C 7/42

[52] U.S. Cl. ..... 430/393; 430/376; 430/418; 430/460; 430/467

[58] Field of Search ..... 430/393, 376, 418, 460, 430/467

[56] References Cited

U.S. PATENT DOCUMENTS 3,997,348 12/1976 Shimamura et al. ..... 430/383
4,170,478 10/1979 Case et al. ..... 430/422
4,774,167 9/1988 Koshimizu et al. ..... 430/380
4,797,350 1/1989 Ohbayashi et al. ..... 430/467
4,801,521 1/1989 Ohki et al. ..... 430/467

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A method of processing a silver halide color photographic material by the steps of (a) developing an imagewise exposed silver halide color photographic material with a color developing solution substantially free from sulfite ions; and (b) immediately contacting the developed silver halide color photographic material with a bleach-fixing solution containing at least one of (i) from $1\times10^{-2}$ mol to 2 mol of bromide ions and (ii) from $5\times10^{-4}$ mol to $5\times10^{-2}$ mol of iodide ions per liter.

In accordance with the method of the invention, silver removal is fully accomplished and the formation of leuco dye is prevented even in rapid processing. Further, the formation of color stain is also prevented.

14 Claims, No Drawings

METHOD FOR PROCESSING A SILVER HALIDE COLOR PHOTOGRAPHIC MATERIAL

FIELD OF THE INVENTION

The present invention relates to a method for processing a silver halide color photographic material and more particularly, to a method for processing a silver halide color photographic material with extremely improved silver removal, in which the leuco formation of dyes is fully prevented despite rapid processing. Further it relates to a method for processing a silver halide color photographic material in which the formation of color stain is prevented as well.

BACKGROUND OF THE INVENTION

Color developing solutions containing an aromatic primary amine color developing agent have been employed for the purpose of forming color images and, at present, are basic to image formation in color photography. However, as is well known, the above described color developing solution has the problem that it tends to be easily oxidized by the air or metals, and in the case of using the oxidized color developing solution in order to form color images, increase in fog, changes in sensitivity and gradation occur and desired photographic properties cannot be obtained.

In particular, with the recent trend of shortening time for processing, the change in photographic properties tends to increase during continuous processing and a severe problem of color stain formation may occur in some cases. Particularly, such a problem is apt to occur when a desilvering step and a water washing step are shortened.

Various reasons for the change in photographic properties and the occurrence of color stain in continuous processing are considered likely. For example, A: a color developing solution is degraded with the lapse of time, as a result, the photographic properties change and the oxidation product of a developing agent adheres to photographic light-sensitive materials, resulting in the formation of color stain;

B: a color developing agent is carried over into a bleaching solution or a bleach-fixing solution and oxidized to form fog and stain, C: a substance dissolved out from photographic light-sensitive materials is accumulated in a color developing solution and adheres to the photographic light-sensitive materials to form color stain, D: due to insufficient washing out of dyes or sensitizing dyes incorporated in photographic light-sensitive materials the photographic light-sensitive materials are colored; or E: a bleach-fixing solution or a subsequent rinse solution is degraded with the lapse of time and color stain occurs.

Particularly, in order to solve problems A and B, it is an indispensable condition to improve the stability of a color developing solution. A sulfite ion has been well known as a preservative for the purpose of increasing stability of a color developing solution. It is also known that incorporation of various sulfites into a color developing solution is effective to prevention from color stain. On the other hand, such a sulfite ion has undesirable effects on photographic properties, in that it deteriorates color forming properties and dissolves silver halide.

In recent years, it has been strongly desired to accelerate processing, that is, to shorten the time necessary for processing. In color development processing, there is a strong need to shorten the time for the desilvering step which occupies nearly one half of the total processing time.

In general, ferricyanides, dichromates, ferric chloride, aminopolycarboxylic acid ferric complex salts, and persulfates are known as bleaching agents.

However, both ferricyanides and dichromates have the problem of environmental pollution with respect to cyanide compounds and hexa-valent chromium compounds. Thus, their use requires special treatment equipment. Ferric chloride also has various practical problems of the formation of iron hydroxide and the occurrence of stain during a water washing step provided thereafter. With respect to persulfates, there is a problem that their bleaching function is very weak and thus a substantially long bleaching time is required.

On the other hand, aminopolycarboxylic acid ferric complex salts (particularly, ethylenediaminetetraacetic acid ferric complex salt) are bleaching agents most widely employed at present, in view of reduced problems of environment pollution and no problem of storage. In order to render the desilvering step rapid, there have been known a bleach-fixing solution, which contains an aminopolycarboxylic acid ferric complex salt and a thiosulfate in a single solution, as described in German Patent No. 866,605. However, the bleaching power of the solution is very weak, since an aminopolycarboxylic acid ferric complex salt which is weak in oxidizing power (bleaching power) and a thiosulfate which has a reducing power coexist in a single solution. Therefore, it is very difficult for the bleach-fixing solution to sufficiently achieve desilvering of color photographic light-sensitive materials and consequently it can not be employed for practical use.

Therefore, for the purpose of increasing the bleaching power there has been proposed a method wherein various bleach accelerating agents are added to a bleaching bath, a bleach fixing bath or a prebath thereof. Examples of such bleach accelerating agents include ammonium bromide as described in JP-A-Nos. 51-87036 (the term "JP-A" as used herein means an "unexamined published Japanese patent application"), a water-soluble iodide salt as described in British Patent No. 926,569, and a halide salt as described in JP-B-Nos. 53-11854 (the term "JP-B" as used herein means an "examined Japanese patent publication").

However, it has been found that when these halide salts are added to a bleach-fixing solution, the desilvering property is not sufficiently improved and they are almost in effective to prevent color stain which may occur in the case of rapid processing or continuous processing of color photographic light-sensitive materials.

Further, when bleach-fixing processing is conducted using a bleach-fixing solution containing an aminopolycarboxylic acid metallic complex salt such as EDTA ferric complex salt, just after a step with a reducing agent is carried over to the bleach-fixing bath with the photographic material and the aminopolycarboxylic acid metallic complex salt is reduced with the reducing agent ptesent in the bleach-fixing solution. The resulting reduction product of aminopolycarboxylic acid metallic complex salt may reduce a colored dye formed, particularly a cyan dye, to form a leuco dye, and as a result, insufficient color restration occurs.

SUMMARY OF THE INVENTION

An object of the present invention is to provide a method for processing a silver halide color photographic material which provides extremely improved desilvering even in rapid processing.

Another object of the present invention is to provide a method for processing a silver halide color photographic material which provides improved color restoration.

A further object of the present invention is to provide a method for processing a silver halide color photographic material in which color stain is prevented.

Other objects of the present invention will become apparent from the following description and examples.

It has been found that these and other objects of the present invention are effectively accomplished by a method for processing a silver halide color photographic material comprising the steps of (a) developing an imagewise exposed silver halide color photographic material with a color developing solution substantially free from sulfite ions; and (b) immediately contacting the developed silver halide color photographic material with a bleach-fixing solution containing at least one of (i) from $1\times10^{-2}$ mol to 2 mol of bromide ions and (ii) from $5\times10^{-4}$ mol to $5\times10^{-2}$ mol of iodide ions per liter of the bleach-fixing solution.

DETAILED DESCRIPTION OF THE INVENTION

As described above, it has been known that desilvering is improved by means of incorporation of a halide ion into a bleach-fixing solution. However, it is unexpected that desilvering is remarkably improved by employing a color developing solution which does not substantially contain a sulfite ion as a bath preceding the bleach-fixing solution, since the possibility of improvement in desilvering by eliminating a sulfite ion from a color developing solution has not been completely known.

On the other hand, it is expected in the art that the problem of color stain will become serious by substantially eliminating a sulfite ion from a color developing solution. However, it surprisingly has now been found that an equivalent or better level of color stain prevention compared to using a sulfite ion in a color developing solution can be obtained by incorporating the specific amount of a halide ion as described above into a bleach-fixing solution without adding a sulfite ion to the color developing solution. Furthermore, it is also effective to improve the color restoration.

The bromide ion and iodide ion which can be used in the present invention are preferably added to the bleach-fixing solution in the form of a water-soluble bromide salt or iodide salt. Specific examples of these compounds include an alkali metal salt, an ammonium salt and an alkaline earth metal salt of the bromide ion or iodide ion, for example, ammonium bromide, sodium bromide, potassium bromide, ammonium iodide, sodium iodide, and potassium iodide.

While preferred effects are obtained by the bromide ion concentration of from $1\times10^{-2}$ mol to 2 mol per liter and the iodide ion concentration of from $5\times10^{-4}$ mol to $5\times10^{-2}$ mol per liter, respectively, the bromide ion concentration is particularly preferably from $1\times10^{-2}$ mol to $5\times10^{-1}$ mol per liter and the iodide concentration is particularly preferably from $5\times10^{-4}$ mol to $1\times10^{-2}$ mol per liter.

When the bromide ion concentration is less than $1\times10^{-2}$ mol per liter of the bleach-fixing solution, the bleach-fixing accelerating effect may not be exhibited and thus it is not preferred in view of the decrease in the remaining amount of silver which is the object of the present invention. On the other hand, when the concentration exceeds 2 mol per liter, insufficient fixing may occur and it is not preferred in view of insufficient desilveration.

Also, when the iodide ion concentration is less than $5\times10^{-4}$ mol per liter of the bleach-fixing solution, it is not preferred in view of the decrease in the remaining amount of silver, just as when the bromide ion concentration is less than $1\times10^{-2}$ mol per liter. On the other hand, the iodide ion concentration exceeds $5\times10^{-2}$ mol per liter, it is not preferred in view of insufficient desilveration, just as when the bromide ion concentration exceeds 2 mol per liter.

Further, when the bromide ion and iodide ion are used together, in the bleach-fixing solution the bromide ion can be incorporated in a range from $1\times10^{-2}$ mol to 2 mol, preferably from $1\times10^{-2}$ to 1 mol, per liter of the solution, and the iodide ion can be incorporated in a range from $5\times10^{-4}$ mol to $5\times10^{-2}$ mol, preferably from $5\times10^{-4}$ mol to $1\times10^{-2}$ mol, per liter of the solution.

The objects of the present invention can be achieved by using any of the bromide ion and iodide ion, and the selection thereof to be used can be appropriately determined depending on the conditions of use.

In order to control the bromide ion and/or iodide ion concentration in the above described range, the compound can be directly added to the bleach-fixing solution, or may be added together with a replenisher. Further, it may partially carried over from the preceding bath (i.e. color developing solution).

The terminology "color developing solution substantially free from a sulfite ions" as used in the present invention means a color developing solution containing no sulfite ion or containing a sulfite ion in an amount that does not effect photographic properties. More specifically, the amount of sulfite ion present in the color developing solution is in a range from 0 mol/l to 0.005 mol/l, preferably from 0 mol/l to 0.002 mol/l.

Further, it is preferred that the color developing solution used in the present invention is substantially free from benzyl alcohol in view of further improvement in desilvering and prevention of the formation of fog and the increase in stain after processing. The term "color developing solution substantially free from benzyl alcohol" as used herein means a color developing solution containing benzyl alcohol in an amount of not more than 5.0 ml per liter, preferably not more than 2 ml per liter of the solution. More preferably, the color developing solution does not contain benzyl alcohol at all.

In the present invention, it is preferred to incorporate an organic preservative into the color developing solution in order to effectively prevent the occurrence of color stain.

The organic preservatives which can be used in the present invention include all organic compounds which can retard the degradation rate of the aromatic primary amine color developing agent when they are added to a processing solution for the color photographic light-sensitive materials. More specifically, organic compounds which prevent the oxidation of the color developing agent by the air, etc., are exemplified. Among them, hydroxylamines, hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring amines, are particularly effective organic preservatives.

These compounds are described, for example, in Japanese Patent Application Nos. 61-197760 and 61-198987, JP-A-Nos. 63-58346, JP-A-Nos. 63-4235, JP-A-Nos. 63-21647, JP-A-Nos. 63-30845, JP-A-Nos. 63-43138, JP-A-Nos. 63-43140, JP-A-Nos. 63-44655, JP-A-Nos. 63-44656 and JP-A-Nos. 63-44657, EP-A No. 254280, U.S. Pat. Nos. 3,615,503 and 2,494,903, JP-A-Nos. 52-143020, and JP-B-Nos. 48-30496.

General formulae and examples of specific compounds of preferred organic preservatives used are illustrated below, but the present invention is not to be construed as being limited thereto.

The amount of the compound described below to be incorporated into the color developing solution is in a range from 0.005 mol/l to 0.5 mol/l, preferably from 0.03 mol/l to 0.1 mol/l.

Of the hydroxylamines, those represented by the following general formula (I) are preferred.

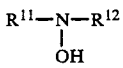

(I)

wherein $R^{11}$ and $R^{12}$, which may be the same or different, each represents hydrogen, an unsubstituted or substituted alkyl group, an unsubstituted or substituted alkenyl group, an unsubstituted or substituted aryl group or an unsubstituted or substituted heteroaromatic group, provided that at least one of $R^{11}$ and $R^{12}$ is a group other than hydrogen, and $R^{11}$ and $R^{12}$ may be linked to form a heterocyclic ring together with the nitrogen atom.

In general formula (I), $R^{11}$ and $R^{12}$ each preferably represents an alkyl group or an alkenyl group. The number of carbon atoms included therein is preferably from 1 to 10, and particularly preferably from 1 to 5.

Suitable examples of the nitrogen-containing heterocyclic group which is formed by linking $R^{11}$ and $R^{12}$ include a piperidyl group, a pyrrolidyl group, an N-alkylpiperazyl group, a morpholyl group, an indolinyl group and a benzotriazolyl group.

Preferred examples of the substituents for the group represented by $R^{11}$ or $R^{12}$ include a hydroxyl group, an alkoxy group, an alkyl- or aryl-sulfonyl group, an amido group, a carboxyl group, a cyano group, a sulfo group, a nitro group and an amino group.

Specific examples of the compounds represented by formula (I) are set forth below, but the present invention is not to be construed as being limited thereto.

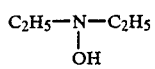

I-1

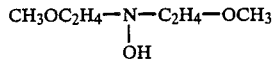

I-2

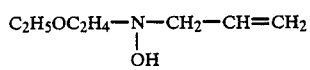

I-3

-continued

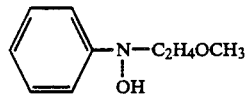

I-4

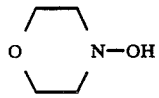

I-5

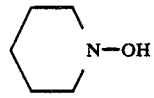

I-6

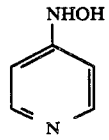

I-7

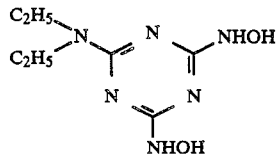

I-8

Of the hydroxamic acids, those represented by the following general formula (II) are preferred.

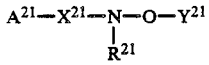

(II)

wherein $A^{21}$ represents hydrogen, a substituted or unsubstituted alkyl group, a substituted or unsubstituted aryl group, a substituted or unsubstituted amino group, a substituted or unsubstituted heterocyclic group, a substituted or unsubstituted alkoxy group, a substituted or unsubstituted aryloxy group, a substituted or unsubstituted carbamoyl group, a substituted or unsubstituted sulfamoyl group, an acyl group, a carboxyl group, a hydroxyamino group, or a hydroxyaminocarbonyl group; $X^{21}$ represents

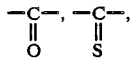

$—SO_2—$ or —SO—; $R^{21}$ represents hydrogen, a substituted or unsubstituted alkyl group or a substituted or unsubstituted aryl group; $A^{21}$ and $R^{21}$ may be linked to form a ring; and $Y^{21}$ represents hydrogen or a group capable of forming hydrogen by hydrolysis.

Suitable examples of the substituents for the group represented by $A^{21}$ include a halogen atom, an aryl group, an alkyl group, and an alkoxy group.

$A^{21}$ preferably represents a substituted or unsubstituted alkyl, aryl, amino, alkoxy or aryloxy group. Particularly preferred groups for $A^{21}$ include a substituted or unsubstituted amino, alkyl or aryloxy group. The number of carbon atoms included therein is preferably from 1 to 10.

$X^{21}$ preferably represents $-\underset{\underset{O}{\|}}{C}-$.

Suitable examples of the substituents for the group represented by $R^{21}$ include those as described for $A^{21}$. $R^{21}$ is preferably a hydrogen atom.

Specific examples of the compounds represented by the general formula (II) are set forth below, but the present invention is not to be construed as being limited thereto:

II-1

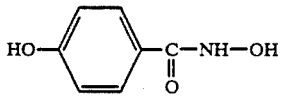

II-2

$CH_2-\underset{\underset{O}{\|}}{C}-NH-OH$

II-3

$C_4H_9O-\underset{\underset{O}{\|}}{C}-NH-OH$

II-4

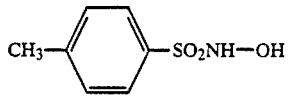

II-5

$CH_3-\underset{\underset{S}{\|}}{C}-\overset{\overset{CH_3}{|}}{N}-OH$

II-6

$H_2N-\underset{\underset{O}{\|}}{C}-NH-OH$

Of the hydrazines and hydrazides, those represented by the following general formula (III) are preferred.

(III)

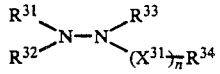

wherein $R^{31}$, $R^{32}$ and $R^{33}$, which may be the same or different, each represents hydrogen, a substituted or unsubstituted alkyl, aryl or heterocyclic group; $R^{34}$ represents a hydroxyl group, a hydroxylamino group, a substituted or unsubstituted alkyl, aryl, heterocyclic, alkoxy, aryloxy, carbamoyl or amino group; $X^{31}$ represents a divalent group selected from —CO—, $—SO_2—$ or $-\underset{\underset{NH}{\|}}{C}-$;

n is 0 or 1, and when n is 0, $R^{34}$ represents a substituted or unsubstituted alkyl, aryl or heterocyclic group; and $R^{33}$ and $R^{34}$ may be linked to form a hetero ring.

In the general formula (III), $R^{31}$, $R^{32}$ and $R^{33}$ each preferably represents hydrogen or an alkyl group. Particularly, it is preferred that $R^{31}$ and $R^{32}$ both are hydrogen.

In the general formula (III), $R^{34}$ preferably represents an alkyl group, an aryl group, an alkoxy group, a carbamoyl group or an amino group.

In the general formula (III), $X^{31}$ preferably represents —CO— or $—SO_2—$, and particularly preferably represents —CO—.

Specific examples of the compounds represented by the general formula (III) are set forth below, but the present invention is not to be construed as being limited thereto.

(III-1)

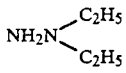

(III-2) $NH_2NH(CH_2)_4SO_3H$ (III-3) $NH_2NH(CH_2)_2OH$ (III-4)

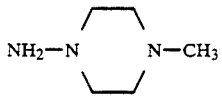

(III-5)

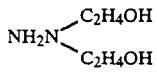

(III-6) $NH_4NHCOCH_3$ (III-7) $NH_2NHCOOC_2H_5$ (III-8)

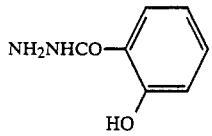

(III-9)

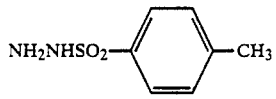

(III-10) $NH_2NHCONH_2$ (III-11)

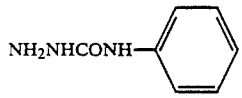

(III-12) $NH_2NHSO_3H$ (III-13)

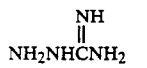

(III-14) $NH_2NHCOCONHNH_2$ (III-15) $NH_2N(CH_2COOH)_2$ (III-16)

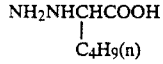

(III-17)

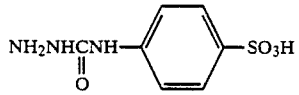

(III-18)

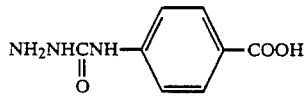

(III-19) $NH_2NHCH_2CH_2CH_2SO_3H$

Of the phenols, those represented by the following general formula (IV) are preferred.

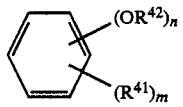

(IV)

wherein $R^{41}$ represents hydrogen, a halogen atom, an alkyl group, an aryl group, an alkoxy group, an aryloxy group, a carboxyl group, a sulfo group, a carbamoyl group, a sulfamoyl group, an amido group, a sulfonamido group, a ureido group, an alkylthio group, an arylthio group, a nitro group, a cyano group, an amino group, a formyl group, an acyl group, a sulfonyl group, an alkoxycarbonyl group, an aryloxycarbonyl group, an alkoxysulfonyl group or an aryloxysulfonyl group; plural $R^{41}$ groups may be the same or different; and two adjacent $R^{41}$ groups may be linked to form a ring; $R^{42}$ represents hydrogen or a group capable of forming hydrogen by hydrolysis; and m and n each is an integer of from 1 to 5 (where $m+n \leqq 6$).

In the general formula (IV), the group represented by $R^{41}$ may be further substituted. Suitable examples of the substituents include a halogen atom, an alkyl group, an aryl group, a hydroxy group, and an alkoxy group. The ring formed by two adjacent $R^{41}$ groups may be a 5-membered or 6-membered ring, may be saturated or unsaturated, and may be composed of a carbon atom, a hydrogen atom, a halogen atom, an oxygen atom, a nitrogen atom and a sulfur atom.

In the general formula (IV), $R^{41}$ preferably represents an alkyl group, a halogen atom, an alkoxy group, an alkylthio group, a carboxy group, a sulfo group, a carbamoyl group, a sulfamoyl group, an amino group, an amido group, a sulfonamido group, a nitro group, or a cyano group. Of these groups, an alkoxy group, an alkylthio group, an amino group and a nitro group are particularly preferred, and it is more preferred that such a group is present at the ortho position or the para position to the group $OR^{42}$. Further, the number of carbon atoms contained in $R^{41}$ is preferably from 1 to 10, and particularly preferably from 1 to 6.

In the general formula (IV), $R^{42}$ preferably represents hydrogen or a group capable of forming hydrogen by hydrolysis having from 1 to 5 carbon atoms. Further, when two or more $OR^{42}$'s are present, it is preferred that they are positioned with respect to each other at ortho or para positions.

Specific examples of the compounds represented by the general formula (IV) are set forth below, but the present invention is not to be construed as being limited thereto.

IV-1

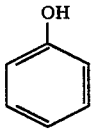

IV-2

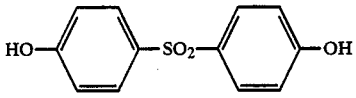

-continued

IV-3

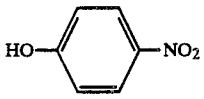

IV-4

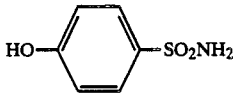

IV-5

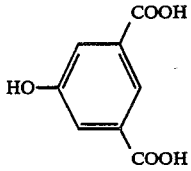

IV-6

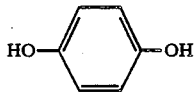

IV-7

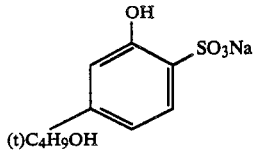

IV-8

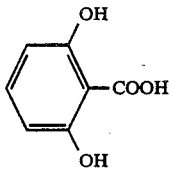

IV-9

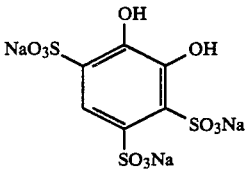

IV-10

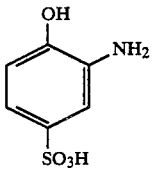

IV-11

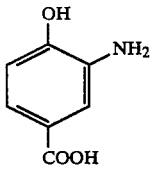

Of the α-hydroxyketones and α-aminoketones, those represented by the following general formula (V) are preferred.

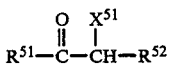

(V)

wherein $R^{51}$ represents hydrogen, or a substituted or unsubstituted alkyl, aryl, alkoxy, aryloxy or amino group; $R^{52}$ represents hydrogen, or a substituted or unsubstituted alkyl or aryl group; $R^{51}$ and $R^{52}$ may be linked to form a carbocyclic ring or a heterocyclic ring; and $X^{51}$ represents a hydroxyl group or a substituted or unsubstituted amino group.

In the general formula (V), $R^{51}$ preferably represents hydrogen, an alkyl group, an aryl group or an alkoxy group, and $R^{52}$ preferably represents hydrogen or an alkyl group.

Specific examples of the compounds represented by the general formula (V) are set forth below, but the present invention is not to be construed as being limited thereto.

(V-1)

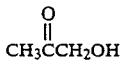

(V-2)

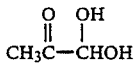

(V-3)

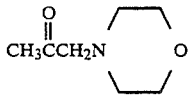

(V-4)

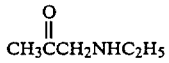

(V-5)

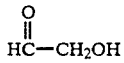

(V-6)

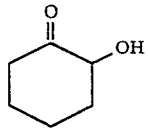

(V-7)

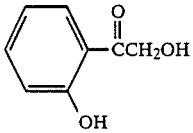

(V-8)

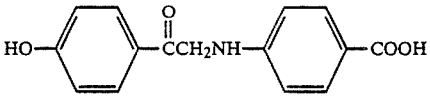

(V-9)

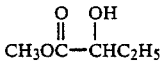

(V-10)

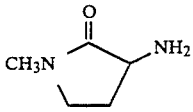

Saccharides are also preferred organic preservatives. Saccharides (also usually called "carbohydrates") are classified into monosaccharides and polysaccharides, and most of them are represented by the general formula $C_nH_{2m}O_m$. Monosacharides generally include aldehydes and ketones of polyvalent alcohols (called aldoses and ketoses, respectively), and also derivatives thereof such as reduction derivatives thereof, oxidation derivatives thereof, dehydration derivatives thereof, amino sugar, and thio sugar. Polysaccharides are products which is formed by dehydration condensation of two or more of the monosaccharides described above.

Of these saccharides, those more preferred are aldoses having a reducing aldehyde group and derivatives thereof, and monosaccharides thereof are particularly preferred.

Specific examples of the saccharides are set forth below, but the present invention is not to be construed as being limited thereto.

D-hexose VI-1

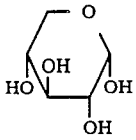

L-arabinose VI-2

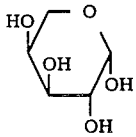

D-ribose VI-3

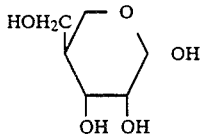

D-deoxyribose VI-4

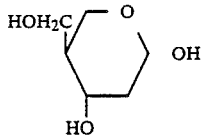

D-glucose VI-5

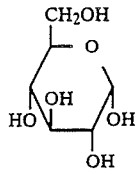

D-galactose VI-6

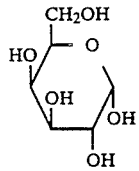

D-mannose VI-7

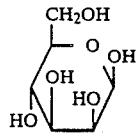

Glucosamine VI-8

-continued

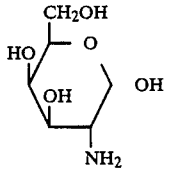

L-sorbose VI-9

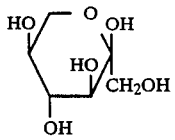

D-sorbite (sorbitol) VI-10

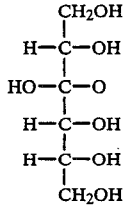

Of the monoamines, those represented by the general formula (VII) are preferred.

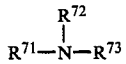

(VII)

wherein $R^{71}$, $R^{72}$ and $R^{73}$, which may be the same or different, each represents hydrogen, an alkyl group, an alkenyl group, an aryl group, an aralkyl group or a heterocyclic group; and $R^{71}$ and $R^{72}$, $R^{71}$ and $R^{73}$ or $R^{72}$ and $R^{73}$ may be linked to form a nitrogen-containing heterocyclic ring.

In the general formula (VII), the group represented by $R^{71}$, $R^{72}$ or $R^{73}$ may be substituted. Suitable examples of the substituents for the group represented by $R^{71}$, $R^{72}$ or $R^{73}$ include those described for $R^{11}$ and $R^{12}$ in general formula (I) above. In the general formula (VII), $R^{71}$, $R^{72}$ and $R^{73}$ each preferably represents hydrogen or an alkyl group.

Specific examples of the compounds represented by the general formula (VII) are set forth below, but the present invention is not to be construed as being limited thereto.

$N(CH_2CH_2OH)_3$ VII-1

$H_2NCH_2CH_2OH$ VII-2

$NH(CH_2CH_2OH)_2$ VII-3

$C_7H_{15}N(CH_2CH(OH)CH_2OH)_2$ VII-4

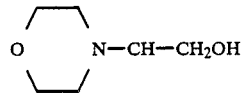

VII-5

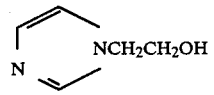

VII-6

-continued

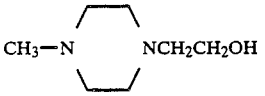

VII-7

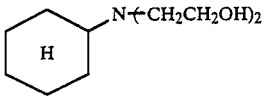

VII-8

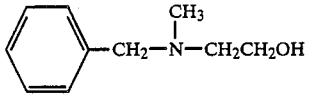

VII-9

$(HOCH_2CH_2)_2NCH_2CH_2SO_2CH_3$ VII-10

$HN(CH_2COOH)_2$ VII-11

$HOOCCH_2CH_2CH(NH_2)COOH$ VII-12

$H_2NCH_2CH_2SO_2NH_2$ VII-13

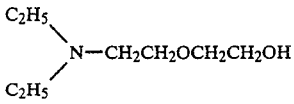

VII-13

$H_2N-C(CH_2OH)_2$ VII-14

$COCH_2CH(NH_2)COOH$ VII-15

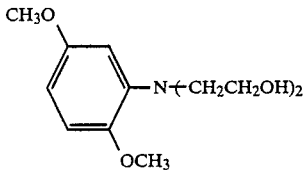

VII-16

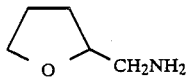

VII-17

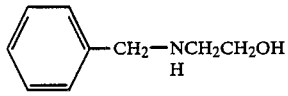

VII-18

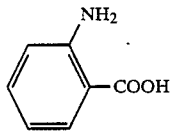

VII-19

Of the diamines, those represented by the following general formula (VIII) are preferred.

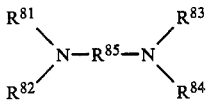

(VIII)

wherein $R^{81}$, $R^{82}$, $R^{83}$ and $R^{84}$, which may be the same or different, each represents hydrogen, an alkyl group, an alkenyl group, an aryl group, an aralkyl group or a heterocyclic group; and $R^{85}$ represents a divalent organic group.

The divalent organic group represented by $R^{85}$ includes an alkylene group, an arylene group, an aralkylene group, an alkenylene group and a heterocyclic group.

In the general formula (VIII), $R^{81}$, $R^{82}$, $R^{83}$ and $R^{84}$ each preferably represents hydrogen or an alkyl group, and $R^{85}$ preferably represents an alkylene group.

Specific examples of the compounds represented by the general formula (VIII) are set forth below, but the present invention is not to be construed as being limited thereto.

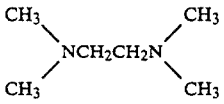
VIII-1

$(CHCH_2CH_2)_2NCH_2CH_2N(CH_2CH_2OH)_2$ VIII-2

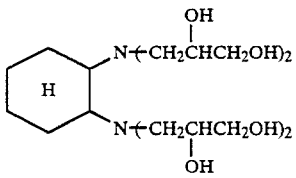
VIII-3

$H_2NCH_2CH_2N(CH_2CH_2OH)_2$ VIII-4

$H_2NCH_2CH(OH)CH_2NH_2$ VIII-5

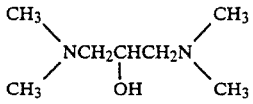
VIII-6

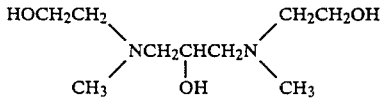
VIII-7

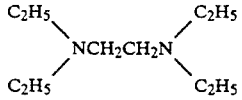
VIII-8

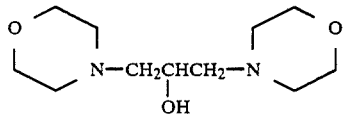
VIII-9

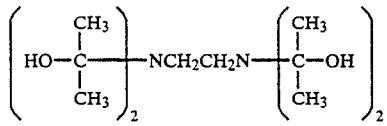
VIII-10

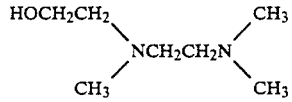
VIII-11

Of the polyamines, those represented by the following general formula (IX) are preferred.

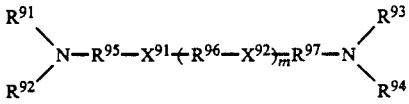
(IX)

wherein $R^{91}$, $R^{92}$, $R^{93}$ and $R^{94}$, which may be the same or different, each represents hydrogen, an alkyl group, an alkenyl group, an aryl group, an aralkyl group or a heterocyclic group; $R^{95}$, $R^{96}$ and $R^{97}$ each represents a divalent organic group; $X^{91}$ and $X^{92}$ each represents $-\overset{R^{98}}{\overset{|}{N}}-$, —O—, —S—, —CO—, —$SO_2$—, —SO—, or a combination thereof; $R^{98}$ has the same meaning as $R^{91}$; and m represents 0 or an integer of at least 1.

The divalent organic group represented by $R^{95}$, $R^{96}$ or $R^{97}$ includes those described for $R^{85}$ in general formula (VIII) above. The upper limit of m is not particularly restricted, and high molecular weight compounds may be employed as far as they are water-soluble. However, it is usually preferred that m is in a range of from 1 to 3.

Specific examples of the compounds represented by the general formula (IX) are set forth below, but the present invention is not to be construed as being limited thereto.

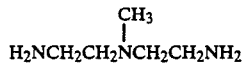
IX-1

$(HOCH_2CH_2)_2NCH_2CH_2OCH_2CH_2N(CH_2CH_2OH)_2$ IX-2

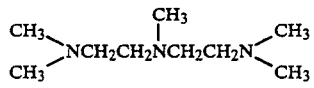
IX-3

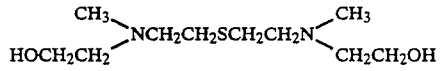
IX-4

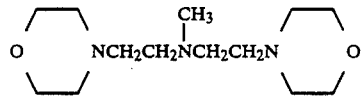
IX-5

$H_2N(CH_2CH_2NH)_nH$ IX-6
n = 500, average molecular weight = 20,000

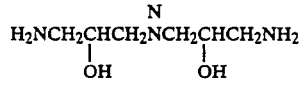
IX-7

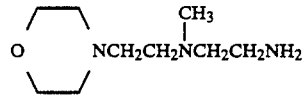
IX-8

Of the quaternary ammonium salts, those represented by the following general formula (X) are preferred.

(X)

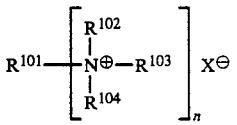

wherein $R^{101}$ represents a n-valent organic group; $R^{102}$, $R^{103}$ and $R^{104}$, which may be the same or different, each represents an organic group, and at least two of $R^{102}$, $R^{103}$ and $R^{104}$ may be linked to form a heterocyclic group containing the quaternary ammonium atom; n represents an integer of at least 1; and $X^{\ominus}$ represents a counter anion.

In general formula (X), $R^{102}$, $R^{103}$ and $R^{104}$ each preferably represents a substituted or unsubstituted alkyl group. Further, it is most preferred that at least one of $R^{102}$, $R^{103}$ and $R^{104}$ is a hydroxyalkyl group, an alkoxyalkyl group or a carboxyalkyl group. n is preferably an integer of from 1 to 3, and more preferably 1 or 2.

Specific examples of the compounds represented by the general formula (X) are set forth below, but the present invention 13 not to be construed as being limited thereto.

X-1

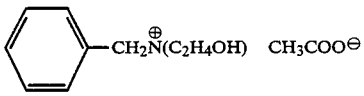

X-2

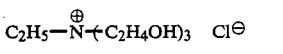

X-3

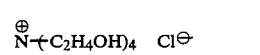

X-4

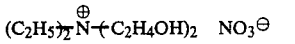

X-5

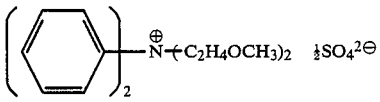

X-6

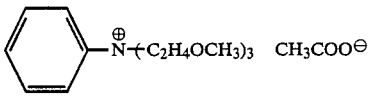

X-7

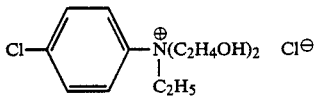

X-8

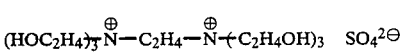

X-9

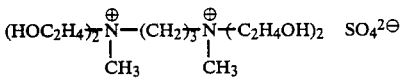

X-10

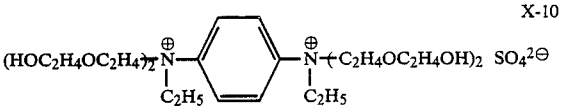

Of the nitroxy radicals, those represented by the following general formula (XI) are preferred.

(XI)

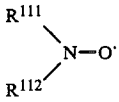

wherein $R^{111}$ and $R^{112}$, which may be the same or different, each represents hydrogen an alkyl group, an aryl group or a heterocyclic group.

The alkyl group, aryl group or heterocyclic group represented by $R^{111}$ or $R^{112}$ may have one or more substituents. Suitable examples of the substituents include a hydroxyl group, an oxo group, a carbamoyl group, an alkoxy group, a sulfamoyl group, a carboxy group, and a sulfo group. Suitable examples of the heterocyclic group include a pyridyl group, and a piperidyl group.

In the general formula (XI), $R^{111}$ and $R^{112}$ each preferably represents a substituted or unsubstituted aryl group or a tertiary alkyl group (for example, tert-butyl).

Specific examples of the compounds represented by the general formula (XI) are set forth below, but the present invention is not to be construed as being limited thereto.

XI-1

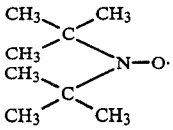

XI-2

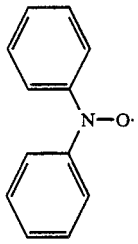

XI-3

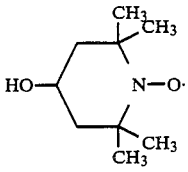

XI-4

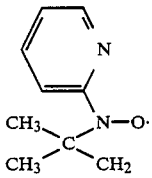

XI-5

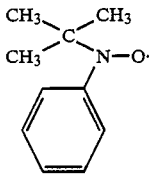

Of the alcohols, those represented by the following general formula (XII) are preferred.

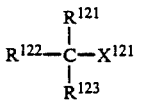

(XII)

wherein $R^{121}$ represents a hydroxyl-substituted alkyl group; $R^{122}$ represents an unsubstituted alkyl group or a hydroxyl-substituted alkyl group; $R^{123}$ represents hydrogen, an unsubstituted alkyl group or a hydroxyl-substituted alkyl group; and $X^{121}$ represents a hydroxyl group, a carboxyl group, a sulfo group, a nitro group, an unsubstituted alkyl group, a hydroxyl-substituted alkyl group, an unsubstituted or substituted amino group or an unsubstituted or substituted sulfonamido group.

In the general formula (XII), $X^{121}$ preferably represents a hydroxyl group, a carboxyl group or a hydroxyl-substituted alkyl group.

Specific examples of the compounds represented by the general formula (XII) are set forth below, but the present invention is not to be construed as being limited thereto.

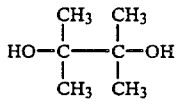

XII-1

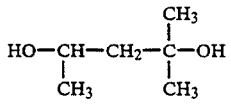

XII-2

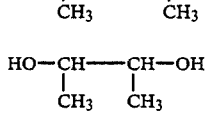

XII-3

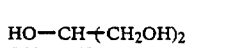

XII-4

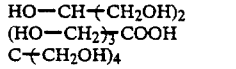

XII-5

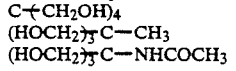

XII-6

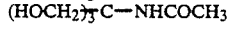

XII-7

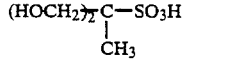

XII-8

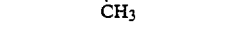

XII-9

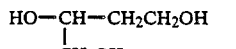

XII-10

Of the alcohols, those represented by the following general formula (XIII) are also preferred.

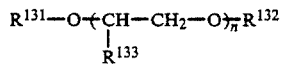

(XIII)

wherein $R^{131}$ and $R^{133}$, which may be the same or different, each represents hydrogen or a substituted or unsubstituted alkyl group; $R^{132}$ represents hydrogen, a substituted or unsubstituted alkyl group, a hydroxy group or a substituted or unsubstituted alkoxy group; and n is a positive integer up to 500.

In the general formula (XIII), the alkyl group represented by $R^{131}$, $R^{132}$ or $R^{133}$ has preferably not more than 5 carbon atoms, and more preferably not more than 2 carbon atoms. $R^{131}$, $R^{132}$ and $R^{133}$ particularly preferably each represents hydrogen or a methyl group and most preferably each represents hydrogen. n preferably is a positive integer from 3 to 100, and more preferably is a positive integer from 3 to 30.

Specific examples of the compounds represented by the general formula (XIII) are set forth below, but the present invention is not to be construed as being limited thereto.

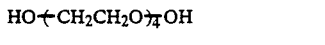

XIII-1

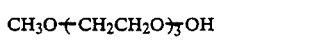

XIII-2

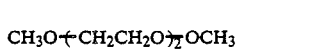

XIII-3

XIII-4

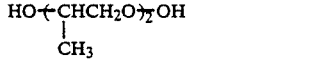

XIII-5

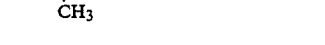

XIII-6

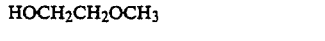

Average molecular weight: about 300

XIII-7

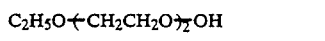

Average molecular weight: about 800

XIII-8

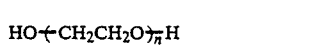

Average molecular weight: about 3,000

XIII-9

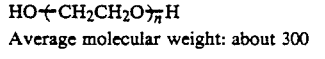

Average molecular weight: about 8,000

XIII-7

Of the oximes, those represented by the following general formula (XIV) are preferred.

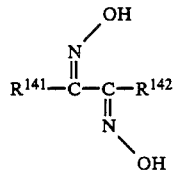

(XIV)

wherein $R^{141}$ and $R^{142}$, which may be the same or different, each represents hydrogen, a substituted or unsubstituted alkyl group or a substituted or unsubstituted aryl group, and $R^{141}$ and $R^{142}$ may be linked to form a ring.

In the general formula (XIV), $R^{141}$ and $R^{142}$ each preferably represents an unsubstituted alkyl group or an alkyl group substituted with one or more substituents selected from a halogen atom, a hydroxyl group, an alkoxy group, an amino group, a carboxyl group, a sulfo group, a phosphonic acid group and a nitro group. Further, the total number of carbon atoms included in the compound represented by the general formula (XIV) is preferably not more than 30, more preferably not more than 20.

Specific examples of the compounds represented by the general formula (XIV) are set forth below, but the present invention is not to be construed as being limited thereto.

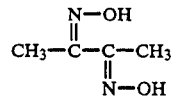

XIV-1

-continued

XIV-2

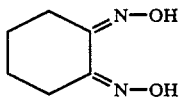

XIV-3

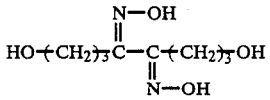

XIV-4

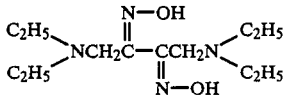

XIV-3

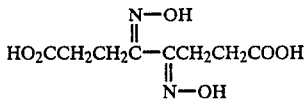

Of the diamide or disulfonamide compounds, those represented by the following general formula (XV) are preferred.

(XV)

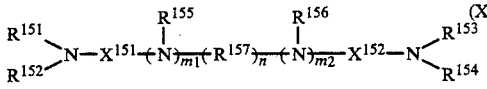

wherein $X^{151}$ and $X^{152}$, which may be the same or different, each represents —CO— or —$SO_2$—; $R^{151}$, $R^{152}$, $R^{153}$, $R^{154}$, $R^{155}$ and $R^{156}$, which may be the same or different, each represents hydrogen or an unsubstituted or substituted alkyl group; $R^{157}$ represents an unsubstituted or substituted alkylene group, an unsubstituted or substituted arylene group or an unsubstituted or substituted aralkylene group; and $m_1$, $m_2$ and n, which may be the same or different, each is 0 or 1.

Specific examples of the compounds represented by the general formula (XV) are set forth below, but the present invention is not to be construed as being

XV-1

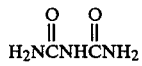

XV-2

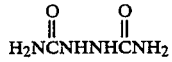

XV-3

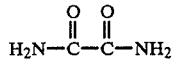

XV-4

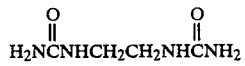

XV-5

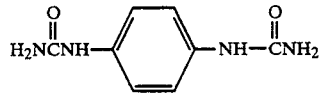

XV-6

$H_2NSO_2NHSO_2NH_2$

Of the condensed ring amines, those represented by the general formula (XVI) are preferred.

(XVI)

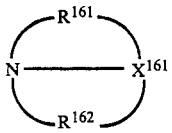

wherein $X^{161}$ represents a trivalent atomic group necessary to complete a condensed ring; and $R^{161}$ and $R^{162}$, which may be the same or different, each represents a substituted or unsubstituted alkylene group, a substituted or unsubstituted arylene group, a substituted or unsubstituted alkenylene group or a substituted or unsubstituted aralkylene group.

Of the compounds represented by the general formula (XVI), those particularly preferred are compounds represented by the following general formula (I-a) or (I-b)

(I-a)

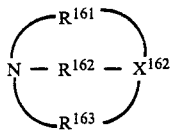

wherein $X^{162}$ represents $R^{161}$ and $R^{162}$ each has the same meaning as defined in general formula (XVI); and $R^{163}$ represents the group $R^{161}$

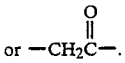

In the general formula (I-a), $X^{162}$ preferably represents

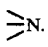

The number of carbon atoms included in each of $R^{161}$, $R^{162}$ and $R^{163}$ is preferably not more than 6, more preferably not more than 3, and most preferably not more than 2. $R^{161}$, $R^{162}$ and $R^{163}$ each preferably represents an alkylene group or an arylene group, and most preferably an alkylene group.

(I-b)

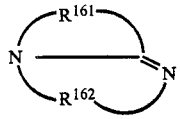

wherein $R^{161}$ and $R^{162}$ each has the same meaning as defined in the general formula (XVI).

In the general formula (I-b), the number of carbon atoms included in each of $R^{161}$ and $R^{162}$ is preferably not more than 6. $R^{161}$ and $R^{162}$ each preferably represents an alkylene group or an arylene group, and most preferably an alkylene group.

Of the compounds represented by the general formulae (I-a) and (I-b), those represented by the general formula (I-a) are preferred.

Specific examples of the compounds represented by the general formula (XVI) are set forth below, but the present invention is not to be construed as being limited thereto.

XVI-1

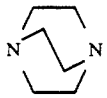

XVI-2

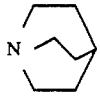

XVI-3

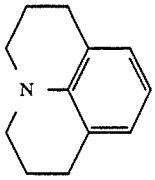

XVI-4

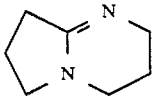

XVI-5

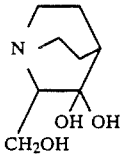

XVI-6

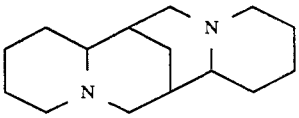

XVI-7

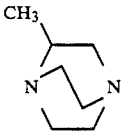

XVI-8

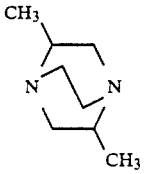

XVI-9

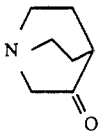

XVI-10

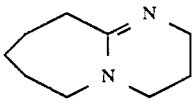

-continued

XVI-11

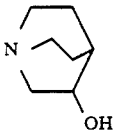

XVI-12

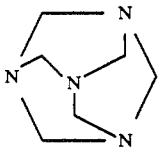

XVI-13

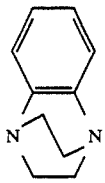

XVI-14

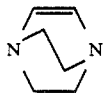

XVI-15

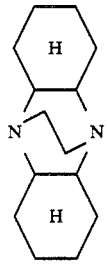

XVI-16

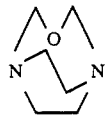

XVI-17

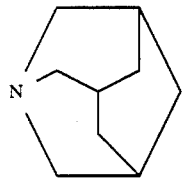

XVI-18

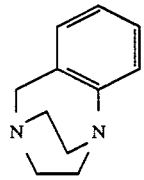

Many of the compounds represented by the general formula (XVI) according to the present invention are easily available as commercial products.

It is preferred that two or more kinds of these preservatives are employed in combination in view of their preservative function Particularly, combinations of at least one compound selected from those represented by the general formulae (I) to (V) and saccharides and at least one compound selected from those represented by the general formulae (VII) to (XVI) are preferably employed. Further, it is more particularly preferred that at least one compound selected from those represented by the general formulae (I) and (III) and at least one compound selected from those represented by the general formulae (VII) and (XVI) are employed together.

These compounds represented by the general formulae (I) to (XVI) can easily be synthesized by referring to, for example, Japanese Patent Application Nos. 61-197760 and 61-198987, JP-A-58346, JP-A-63-4235, JP-A-63-21647, JP-A-63-30845, JP-A-63-43138, JP-A-63-43140, JP-A-63-44655, JP-A-63-44656 and JP-A-63-44657, EP-A-No. 254280, U.S. Pat. Nos. 3,615,503 and 2,494,903, JP-A-No. 52-143020, and JP-B-No. 48-30496.

Now, the color developing solution which can be used in the present invention is described in detail below.

The color developing solution used in the present invention contains a known aromatic primary amine color developing agent. Preferred examples thereof are p-phenylenediamine derivatives. Typical examples of the p-phenylenediamine derivative used are set forth below, but the present invention is not to be construed as being limited thereto.

D-1: N,N-Diethyl-p-phenylenediamine

D-2: 4-[N-Ethyl-N-(β-hydroxyethyl)amino]aniline

D-3: 2-Methyl-4-[N-ethyl-N-(β-hydroxyethyl-)amino]aniline

D-4: 4-Amino-3-methyl-N-ethyl-N-[β-(methanesulfonamido)ethyl]aniline

These p-phenylenediamine derivatives may be in the form of salts such as sulfates, hydrochlorides, or p-toluenesulfonates.

The aromatic primary amine developing agent is used in an amount of from about 0 1 g to about 20 g and preferably from about 0.5 g to about 10 g per liter of the developing solution.

The color developing solution used in the present invention has a pH which ranges preferably from 9 to 12 and more preferably from 9 to 11.0. The color developing solution may also contain any of the compounds that are known to be usable as components of developing solutions.

In order to maintain the pH in the above-described range, various kinds of buffers are preferably employed Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo 2-hydroxybenzoate (potassium 5-sulfosalicylate).

The amount of the buffer to be added to the color developing solution is preferably 0.1 mol or more and more preferably from 0.1 mol to 0.4 mol per liter thereof.

In addition, various chelating agents can be used in the color developing solution according to the present invention for the purpose of preventing calcium or magnesium precipitation or increasing the stability of the color developing solution.

Specific examples of the chelating agents used are set forth below, but the present invention is not to be construed as being limited thereto.

Nitrilotriacetic acid
Diethylenetriaminepentaacetic acid
Ethylenediaminetetraacetic acid
Triethylenetetraminehexaacetic acid
N,N,N-Trimethylenephosphonic acid
Ethylenediamine-N,N,N',N'-tetramethylenephosphonic
1,3-Diamino-2-propanoltetraacetic acid
Trans-cyclohexanediaminetetraacetic acid
Nitrilotripropionic acid
1,2-Diaminopropanetetraacetic acid
Hydroxyethyliminodiacetic acid
Glycol ether diamine tetraacetic acid
Hydroxyethylenediaminetriacetic acid
Ethylenediamine o-hydroxyphenylacetic acid
2-Phosphonobutane-1,2,4-tricarboxylic acid
1-Hydroxyethylidene 1,1-diphosphonic acid
N,N'-Bis(2-hydroxybenzyl)ethylenediamine-N,N'-diacetic acid Two or more kinds of such chelating agents may be employed together, if desired.

The chelating agent is added to the color developing solution in an amount sufficient to block metal ions present therein. For example, a range of from about 0.1 g to about 10 g per liter of the color developing solution is employed.

The color developing solution may contain appropriate development accelerators, if desired.

Examples of suitable development accelerators include thioether type compounds as described in JP-B-No. 37-16088, JP-B-No. 37-5987, JP-B-No. 38-7826, JP-B-No. 44-12380, JP-B-No. 45-9019 and U.S. Pat. No. 3,813,247; p-phenylenediamine type compounds as described in JP-A-No. 52-49829, JP-A-No. 50-15554; quaternary ammonium salts as described in JP-A-No. 50-137726, JP-B-No. 44-30074, JP-A-No. 56-156826, JP-A-No. 52-43429; p-aminophenols as described in U.S. Pat. Nos. 2,610,122 and 4,119,462; amine type compounds as described in U.S. Pat. Nos. 2,494,903, 3,128,182, 4,230,796, 3,253,919, 2,482,546, 2,596,926, and 3,582,346 and JP-B-No. 41-11431; polyalkylene oxides as described in JP-B-No. 37-16088, JP-B-No. 42-25201, JP-B-No. 41-11431, JP-B-No. 42-23883, and U.S. Pat. Nos. 3,128,183 and 3,532,501; 1-phenyl-3-pyrazolidones; hydrazines; mesoionic type compounds; thione type compounds; and imidazoles.

The color developing solution used in the present invention may contain appropriate antifoggants, if desired. Alkali metal halides such as sodium chloride, potassium bromide, and potassium iodide as well as organic antifoggants may be employed as antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

It is preferred that the color developing solution according to the present invention contains fluorescent brightening agents. As fluorescent brightening agents, 4,4'-diamino-2,2'-disulfostilbene type compounds are preferred. The amount of the fluorescent brightening agent added is from 0 to 5 g and preferably from 0.1 g to 4 g per liter of the color developing solution.

Furthermore, the color developing solution according to the present invention may contain various surface active agents such as alkylphosphonic acids, arylphosphonic acids, aliphatic carboxylic acids, and aromatic carboxylic acids, if desired.

The processing temperature of the color developing solution used in the present invention is usually from 20° C. to 50° C. and preferably from 30° C. to 40° C. The processing time is usually from 20 sec. to 5 min. and preferably from 30 sec. to 2 min. Further, the amount of a replenisher for the color developing solution is preferred to be as small as possible. It is usually from 20 ml to 600 ml, preferably from 50 ml to 300 ml, and more preferably from 100 ml to 200 ml per square meter of the color photographic light-sensitive material.

Now, the bleach-fixing solution which can be used in the present invention is described in detail below.

Bleaching agents used in the bleach-fixing solution according to the present invention include any bleaching agent known in the art. Particularly, organic complex salts of iron (III), for example, complex salts of aminopolycarboxylic acids (e.g., ethylenediaminetetraacetic acid, diethylenetriaminepentaacetic acid), aminopolyphosphonic acids, phosphonocarboxylic acids and organic phosphonic acids, or complex salts of organic acids (e.g., citric acid, tartaric acid, malic acid); persulfates; and hydrogen peroxide are preferably used. Of these compounds, organic complex salts of iron (III) ar particularly preferred in view of rapid processing and prevention of environmental pollution.

Specific examples of useful aminopolycarboxylic acids, aminopolyphosphonic acids, organic phosphonic acids, and salts thereof suitable for forming organic complex salts of iron (III) are set forth below, but the present invention is not to be construed as being limited thereto.

Ethylenediaminetetraacetic acid
Diethylenetriaminepentaacetic acid
1,3-Diaminopropanetetraacetic acid
Propylenediaminetetraacetic acid
Nitrilotriacetic acid
Cyclohexanediaminetetraacetic acid
Methyliminodiacetic acid
Iminodiacetic acid
Glycol ether diaminetetraacetic acid These compounds may be in the form of salt such as sodium, potassium, lithium or ammonium.

Of these compounds, iron (III) complex salt of ethylenediaminetetraacetic acid, diethylenetriaminepentaacetic acid, cyclohexanediaminetetraacetic acid, 1,3-diaminopropanetetraacetic acid or methyliminodiacetic acid are preferred because of their high bleaching ability.

The ferric ion complex salts may be used in the form of a complex salt per se or may be formed in situ in solution by using a ferric salt (e.g., ferric sulfate, ferric chloride, ferric nitrate, ferric ammonium sulfate or ferric phosphate) and a chelating agent (e.g., an aminopolycarboxylic acid, an aminopolyphosphonic acid, a phosphonocarboxylic acid). Further, a chelating agent may be used in an amount in excess of that necessary for forming a ferric ion complex salt.

Of the ferric ion complexes, an aminopolycarboxylic acid ferric ion complex is preferred.

The amount of ferric iron complex in the bleach-fixing solution is from 0.01 mol to 1.0 mol, preferably from 0.05 mol to 0.50 mol per liter of the solution.

In the bleach-fixing solution, as bleach accelerating agents, various kinds of compounds can be used in addition to the halide ion according to the present invention. Specific examples of suitable bleach accelerating agents include compounds having a mercapto group or a disulfide bond as described in U.S. Pat. No. 3,893,858, West German Patent No. 1,290,812, JP-A-No. 53-95630, and *Research Disclosure,* No. 17129 (July, 1978); and thiourea type compounds as described in JP-B-No. 45-8506, JP-A-No. 52-20832, JP-A-No. 53-32735, and U.S. Pat. No. 3,706,561. These compounds are preferred in view of their large bleaching ability.

Further, to the bleach-fixing solution used in the present invention, one or more kinds of inorganic acids, organic acids, alkali metal salts thereof or ammonium salts thereof which have a pH buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, tertaric acid), corrosion preventing agents (e.g., ammonium nitrate, guanidine), or the like may be added, if desired.

As fixing agents which can be employed in the bleach-fixing solution according to the present invention, known fixing agents, that is, water-soluble silver halide solvents such as thiosulfates (e.g., sodium thiosulfate, ammonium thiosulfate); thiocyanates (e.g., sodium thiocyanate, ammonium thiocyanate, etc.); thioether compounds (e.g., ethylenebisthioglycolic acid, 3,6-dithia-1,8-octanediol); and thioureas are used individually or as a combination of two or more. In addition, a special bleach-fixing solution containing a combination of fixing agent and a large amount of a halide compound such as potassium iodide as described in JP-A-No. 55-155354 can be used as well. In the present invention, a thiosulfate, particularly ammonium thiosulfate is preferably employed.

The amount of fixing agent to be used in the bleach-fixing solution is preferably from 0.3 mol to 2 mol, and more preferably from 0.5 mol to 1.0 mol per liter of the solution.

The pH of the bleach-fixing solution used in the present invention is preferably from 3 to 10, and more preferably from 5 to 9.

Further, various kinds of fluorescent brighten ing agent, defoaming agents and surface active agents, polyvinyl pyrrolidone, organic solvents (e.g., methanol) may be incorporated into the bleach-fixing solution.

The bleach-fixing solution used in the present invention can contain, as preservatives, compounds capable of releasing sulfite ions such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite. The amount of such a compound to be added is preferably from about 0.02 mol to about 0.50 mol, and more preferably from 0.04 mol to 0.40 mol per liter of the solution calculated in terms of the sulfite ion.

While it is typical to add sulfites as preservatives, other compounds such as ascorbic acid, a carbonyl-bisulfic acid adduct, a sulfinic acid described in Japanese Patent Application No. 62-142941, or a carbonyl compound may be added.

Further, buffers, fluorescent brightening agents, chelating agents, deforming agents and antimolds may be added, if desired.

When the processing time of the desilvering step in the present invention is shortened, the effects of the present invention become more remarkable. Therefore, the time for the desilvering step is preferably up to 2 minutes, more preferably up to 1 minute, particularly preferably from 10 seconds to 1 minute.

After a silver removing processing such as bleach-fixing, the silver halide color photographic material according to the present invention is generally subjected to a water washing step and/or a stabilizing step.

An amount of water required for the water washing step may be set in a wide range depending on characteristics of photographic light-sensitive materials (due to elements used therein, for example, couplers), uses thereof, temperature of washing water, the number of water washing tanks (stages), the replenishment system such as countercurrent or co-current, or other various conditions. The relationship between the number of water washing tanks and the amount of water in a multi-stage countercurrent system can be determined based on the method described in *Journal of the Society of Motion Picture and Television Engineers,* Vol. 64, pages 248 to 253 (May, 1955). Ordinarily, the number of stages used in the multi-stage countercurrent system is preferably from 2 to 6, particularly from 2 to 4.

According to the multi-stage countercurrent system, the amount of water for washing can be significantly reduced. For example, it is possible to use 1 liter or less, preferably 0.5 liter or less, per $m^2$ of the photographic light-sensitive material to achieve fully the effect of the present invention. However, an increase in standing time of water in a tank causes propagation of bacteria, and some problems such as adhesion of scum formed on the photographic materials occur. In the processing of the silver halide color photographic material according to the present invention, a method for reducing amounts of calcium and magnesium as described in JP-A-No. 62-288838 can be particularly effectively employed in order to solve such problems. Further, sterilizers, for example, isothiazolone compounds and thiabendazoles as described in JP-A-No. 57-8542, chlorine type sterilizers such as sodium chloroisocyanurate as described in JP-A-No. 61-120145, benzotriazoles as described in JP-A-No. 61-267761, sterilizers as described in Hiroshi Horiguchi, *Bokin-Bobai No Kaqaku, Biseibutsu No Mekkin-, Sakiin-, Bobai-Gijutsu,* edited by Eiseigijutsu Kai, *Bokin-Bobaizai Jiten,* edited by Nippon Bokin-Bobai Gakkai, can be employed.

Moreover, surface active agents as agents for uniform drying, and chelating agents represented by EDTA as water softeners may be employed in washing water.

Following the above described water washing step or without conducting the water washing step, the color photographic material can be directly treated with a stabilizing solution. To the stabilizing solution are added compounds having a function of stabilizing images, for example, aldehyde compounds represented by formalin, buffers for adjusting pH of layer to a value suitable for stabilization of dyes formed, or ammonium compounds. Further, various sterilizers or antimolds as described above can be employed in the stabilizing solution in order to prevent the propagation of bacteria in the solution and impart antimold properties to the photographic material after processing. Moreover, surface active agents, fluorescent brightening agents or hardeners may be added to the stabilizing solution.

The photographic light-sensitive material can be directly subjected to stabilizing processing without conducting the water washing step in the processing according to the present invention. In such a case, any known methods described in JP-A-Nos. 57-8543, 58-14834 or 60-220345 can be employed.

Further, a chelating agent such as 1-hydroxyethylidene-1,1-diphosphonic acid, ethylenediaminetetramethylenephosphonic acid, a magnesium compound, or a bismuth compound may be preferably employed.

By applying a multi-stage countercurrent system to the stabilizing step same as in the water washing step, the amount of water can be significantly reduced, for example, in a range of preferably 1 liter/$m^2$ or less, more preferably 0.5 liter/$m^2$ or less. The replenishment of washing water or a stabilizing solution may be conducted either continuously or intermittently. In the latter case, the replenishment is carried out depending on the amount of photographic materials processed or at intervals of a fixed period.

The pH of the liquid used in the water washing step and stabilizing step according to the present invention is usually from 4 to 10 and preferably from 5 to 8. The temperature can be set in a wide range depending on characteristics of photographic light-sensitive materials and uses thereof. It is selected usually in a range of from 15° C. to 45° C., preferably from 20° C. to 40° C. The processing time can also be appropriately set in a wide range. However, since more remarkable effects of the present invention can be obtained when the processing time is shorter, it is preferably from 30 sec. to 2 min., more preferably from 30 sec. to 1 min. 30 sec. It is preferred that the amount of replenishment is small in view of the reduction of running costs, the amount of discharge, and the method of handling. Further, greater effects can be obtained when the smaller amount of replenishment is employed.

A suitable amount of replenishment is from 0.5 to 50 times, preferably from 3 to 40 times the amount of processing solution carried over from the preceding bath per unit area of the color photographic light-sensitive material.

The solutions used in the water washing step and/or stabilizing step can be further utilized in preceding steps. For instance, the overflow from washing water in a multi-stage countercurrent system is introduced into a bleach-fixing bath which is a preceding bath and a concentrated solution is supplied to the bleach-fixing solution, whereby the amount of discharge is reduced.

In the present invention, it is preferred that the total time for the bleach-fixing step and the water washing step and/or stabilizing step is from 20 seconds to 3 minutes.

The method according to the present invention can be applied to any processing method in which a color developing solution is employed. For example, it can be utilized in processing of color paper, color reversal paper, direct positive color light-sensitive materials, color positive films, color negative films or color reversal films. Particularly, it is preferably applied for the processing of color paper and color reversal paper which are sensitive to the formation of stain.

In a silver halide emulsion of the photographic light-sensitive material used in the present invention, silver halide having any halogen composition such as silver iodobromide, silver bromide, silver chlorobromide or silver chloride can be employed. However, in the case of conducting rapid processing or processing with a low level of replenishment, a silver chlorobromide emulsion containing not less than 80 mol % of silver chloride and a silver chloride emulsion are preferred, and a silver halide emulsion having a silver chloride content of from 90 to 100 mol % is particularly preferred. The effects of the present invention are particularly remarkable when rapid processing or processing with a low level of replenishment are performed using the above described silver halide emulsion.

The silver halide grains in the silver halide emulsion which can be used in the present invention may have different layers in the inner portion and the surface portion, multi-phase structures containing junctions or may be uniform throughout the grains. Further, a mixture of silver halide grains having different structures may be employed.

The average grain size of silver halide grains in the silver halide emulsion used in the present invention (the grain size being defined as grain diameter if the grain has a spherical or approximately spherical shape, or as the edge length in the case of cubic grains, and being averaged based on the projected areas of the grains, and in case of tabular grains being indicated in terms of a circle with the same area) is preferably from 0.1 μm to 2 μm and more preferably from 0.15 μm to 1.5 μm.

The grain size distribution of silver halide grains used in the present invention may be either narrow or broad. It is preferred to employ a monodisperse silver halide emulsion in which the coefficient of variation (which is obtained by dividing the standard deviation derived from a grain size distribution curve of a silver halide emulsion by the average grain size) is 20% or less and particularly 15% or less in the present invention.

Further, in order to achieve the desired gradation of the photographic light-sensitive material, two or more monodisperse silver halide emulsions which have substantially same spectral sensitivity but have different grain sizes from each other can be mixed in one emulsion layer or can be coated in the form of superimposed layers (regarding monodispersity, those having the coefficient of variation described above are preferred). Moreover, two or more polydisperse silver halide emulsions or combinations of a monodisperse emulsion and a polydisperse emulsion may be employed in a mixture or in the form of superimposed layers.

Silver halide grains which can be used in the present invention may have a regular crystal structure, for example, a cubic, octahedral, rhombic dodecahedral or tetradecahedral structure, or a mixture thereof, an irregular crystal structure, for example, a spherical structure, or a composite structure thereof.

Further, tabular silver halide grains can be used. Particularly, a silver halide emulsion in which tabular silver halide grains having a ratio of diameter/thickness of from 5 to 8, or of more than 8 account for at least 50% of the total projected area of the silver halide grains present can be employed. In addition, mixtures of silver halide grains having different crystal structures described above may be used.

These silver halide emulsions may be of surface latent image type, in which latent images are formed mainly on the surface thereof, or of internal latent image type, in which latent images are formed mainly in the interior thereof.

The photographic emulsions used in the present invention can be prepared according to the methods as described in *Research Disclosure,* Vol. 176, No. 17643, Items I, II and III (December, 1978).

The photographic emulsions used in the present invention are usually treated by physical ripening, chemical ripening and spectral sensitization. Various kinds of additives which can be used in these steps are described in *Research Disclosure,* Vol. 176, No. 17643 (December, 1978) and ibid., Vol. 187, No. 18716 (November, 1979), summarized in the table below.

Further, known photographic additives which can be used in the present invention are also described in the above mentioned Research Disclosures as summarized in the table below.

| Kind of Additives | RD 17643 | RD 18716 |
|---|---|---|
| 1. Chemical Sensitizers | Page 23 | Page 648, right column |
| 2. Sensitivity Increasing Agents | | Page 648, right column |
| 3. Spectral Sensitizers | Pages 23 to 24 | Page 648, right column to page 649, right column |
| 4. Super Sensitizers | | |
| 5. Whitening Agents | Page 24 | |
| 6. Antifoggants and Stabilizers | Pages 24 to 25 | Page 649, right column |
| 7. Couplers | Page 25 | |
| 8. Organic Solvents | Page 25 | |
| 9. Light-Absorbers, Filter Dyes and Ultraviolet Ray Absorbers | Pages 25 to 26 | Page 649, right column to page 650, left column |
| 10. Antistaining Agents | Page 25, right column | Page 650, left column to right column |
| 11. Dye Image Stabilizers | Page 25 | |
| 12. Hardeners | Page 26 | Page 651, left column |
| 13. Binders | Page 26 | Page 651, left column |
| 14. Plasticizers and Lubricants | Page 27 | Page 650, right column |
| 15. Coating Aids and Surfactants | Pages 26 to 27 | Page 650, right column |
| 16. Antistatic Agents | Page 27 | Page 650, right column |

Various color couplers can be employed in the present invention. The term "color coupler" as used herein refers to a compound capable of forming a dye upon a coupling reaction with the oxidation product of an aromatic primary amine developing agent. Typical examples of useful color couplers include naphthol or phenol type compounds, pyrazolone or pyrazoloazole type compounds and open-chain or heterocyclic ketomethylene type compounds. Specific examples of utilizable cyan, magenta and yellow couplers in the present invention are described in the patents cited in *Research Disclosure,* No. 17643, VII-D (December, 1978) and ibid., No. 18717 (November, 1979).

It is preferred that couplers which are incorporated into photographic light-sensitive materials are made diffusion resistant by a ballast group or polymerization. It is also preferred that the coupling active sites of couplers be substituted with a group capable of being released (two-equivalent couplers) rather than with a hydrogen atom (four-equivalent couplers), since the coating amount of silver is reduced. Further, couplers which form dyes having an appropriate diffusibility, non-color-forming couplers, or couplers capable of releasing development inhibitors (DIR couplers) or development accelerators accompanying the coupling reaction can be employed.

As typical yellow couplers used in the present invention, oil protected acylacetamide type couplers are exemplified. Specific examples thereof are described in U.S. Pat. Nos. 2,407,210, 2,875,057, and 3,265,506. In the present invention, two-equivalent yellow couplers are preferably employed, and typical examples thereof include yellow couplers of the oxygen atom-releasing type as described in U.S. Pat. Nos. 3,408,194, 3,447,928, 3,933,501, and 4,022,620; and yellow couplers of the nitrogen atom-releasing type as described in JP-B-Nos. 55-0739, U.S. Pat. Nos. 4,401,752 and 4,326,024, *Research Disclosure,* RD No. 18053 (April, 1979), British Patent No. 1,425,020, West German Patent Application (OLS) Nos. 2,219,917, 2,261,361, 2,329,587, and 2,433,812. α-Pivaloylacetanilide type couplers are characterized by good fastness, particularly good light fastness, of the dyes formed, and α-benzoylacetanilide type couplers are characterized by providing high color density.

As magenta couplers used in the present invention, oil protected indazolone type couplers and cyanoacetyl type couplers, preferably 5-pyrazolone type couplers and pyrazoloazole type couplers such as pyrazolotriazoles, are exemplified. Of 5-pyrazolone type couplers, those substituted with an arylamino group or an acylamino group at the 3-position thereof are preferred in view of hue and color density of the dyes formed. Typical examples thereof are described in U.S. Pat. Nos. 2,311,082, 2,343,703, 2,600,788, 2,908,573, 3,062,653, 3,152,896, and 3,936,015. For two-equivalent 5-pyrazolone type couplers, nitrogen atom-releasing groups as described in U.S. Pat. No. 4,310,619 and arylthio groups as described in U.S. Pat. No. 4,351,897 are preferred as releasing groups. Further, 5-pyrazolone type couplers having a ballast group as described in European Patent No. 73,636 are advantageous because they provide high color density.

Examples of pyrazoloazole type couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure,* RD No. 24220 (June, 1984), and pyrazolopyrazoles as described in *Research Disclosure,* RD No. 24230 (June, 1984). Imidazo[1,2-b]pyrazoles as described in European Patent No. 119,741 are preferred, and pyrazolo[1,5-b][1,2,4]triazoles as described in European Patent No. 119,860 are particularly preferred in view of reduced yellow subsidiary absorption and light fastness of the dyes formed.

As cyan couplers used in the present invention, oil protected naphthol type and phenol type couplers are exemplified. Typical examples thereof include naphthol type couplers as described in U.S. Pat. No. 2,474,293 and preferably oxygen atom-releasing type two equivalent naphthol type couplers as described in U.S. Pat. Nos. 4,052,212, 4,146,396, 4,228,233, and 4,296,200. Specific examples of phenol type couplers are described in U.S. Pat. Nos. 2,369,929, 2,801,171, 2,772,162, and 2,895,826.

Cyan couplers fast to humidity and temperature are preferably used in the present invention. Typical examples thereof include phenol type cyan couplers having an alkyl group higher than a methyl group at the meta-position of the phenol nucleus as described in U.S. Pat. No. 3,772,002; 2,5-diacylamino-substituted phenol type couplers as described in U.S. Pat. Nos. 2,772,162, 3,758,308, 4,126,396, 4,334,011, and 4,327,173, West German Patent Application (OLS) No. 3,329,729, and JP-A-No. 59-166956; and phenol type couplers having a phenylureido group at the 2-position thereof and an acylamino group at the 5-position thereof as described in U.S. Pat. Nos. 3,446,622, 4,333,999, 4,451,559, and 4,427,767.

In particular, according to the method of processing a color photographic light-sensitive material of the present invention, good photographic properties with reduced fog formation can be obtained when the photographic light-sensitive material contains at least one cyan coupler represented by the following general formula (C). Such effects are particularly remarkable.

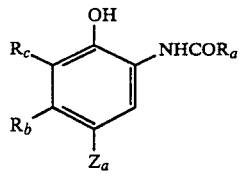

(C)

wherein $R_a$ represents a substituted or unsubstituted alkyl group, a substituted or unsubstituted cycloalkyl group, a substituted or unsubstituted aryl group, a substituted or unsubstituted amino group, or a substituted or unsubstituted heterocyclic group; $R_b$ represents a substituted or unsubstituted acylamino group or a substituted or unsubstituted alkyl group having at least 2 carbon atoms; $R_c$ represents hydrogen, a halogen atom, a substituted or unsubstituted alkyl group, or a substituted or unsubstituted alkoxy group; $R_b$ and $R_c$ may be linked to form a ring; and $Z_a$ represents hydrogen, a halogen atom, or a group capable of being released by a coupling reaction with the oxidation product of an aromatic primary amine color developing agent.

The cyan coupler represented by the general formula (C) is now described in detail below.

In the general formula (C), the alkyl (including cycloalkyl) group represented by $R_a$ is preferably an alkyl group having from 1 to 32 carbon atoms (for example, methyl, butyl, tridecyl, cyclohexyl or allyl). Examples of the aryl group represented by $R_a$ include, for example, a phenyl group and a naphthol group. Examples of the heterocyclic group represented by $R_a$ include, for example, a 2-pyridyl group and a 2-furyl group.

The amino group represented by $R_a$ is a substituted or unsubstituted amino group, and preferably an amino group substituted with a phenyl group which may be further substituted.

These groups may be substituted with one or more substituents selected from an alkyl group, an aryl group, an alkyl- or aryloxy group (for example, methoxy, dodecyloxy, methoxyethoxy, phenoxy, 2,4-di-tert-amylphenoxy, 3-tert-butyl-4-hydroxyphenoxy, naphthyloxy), a carboxyl group, an alkyl- or arylcarbonyl group (for example, acetyl, tetradecanoyl, benzoyl), an alkyl- or aryloxycarbonyl group (for example, methoxycarbonyl, phenoxycarbonyl), an acyloxy group (for example, acetoxy, benzoyloxy), a sulfamoyl group (for example, N-ethylsulfamoyl, N-octadecylsulfamoyl), a carbamoyl group (for example, N-ethylcarbamoyl, N-methyl-dodecylcarbamoyl), a sulfonamido group (for example, methanesulfonamido, benzenesulfonamido), an acylamino group (for example, acetylamino, benzamido, ethoxycarbonylamino, phenylaminocarbonyl amino), an imido group (for example, succinimido, hydantoinyl), a sulfonyl group (for example, methanesulfonyl), a hydroxyl group, a cyano group, a nitro group and a halogen atom.

Suitable examples of the group capable of being released represented by $Z_a$ include a halogen atom (for example, fluorine, chlorine, bromine), an alkoxy group (for example, dodecyloxy, methoxycarbamoylmethoxy, carboxypropyloxy, methylsulfonylethoxy), an aryloxy group (for example, 4-chlorophenoxy, 4-methoxyphenoxy), an acyloxy group (for example, acetoxy, tetradecanoyloxy, benzoyloxy), a sulfonyloxy group (for example, methanesulfonyloxy, toluenesulfonyloxy), an amido group (for example, dichloroacetylamino, methanesulfonylamino, toluenesulfonylamino), an alkoxycarbonyloxy group (for example, ethoxycarbonyloxy, benzyloxycarbonyloxy), an aryloxycarbonyloxy group (for example, phenoxycarbonyloxy), an aliphatic or aromatic thio group (for example, phenylthio, a tetrazolylthio), an imido group (for example, succinimido, hydantoinyl), an N-heterocyclic group (for example, 1-pyrazolyl, 1-benzotriazolyl), and an aromatic azo group (for example, phenylazo). These groups capable of being released may contain a photographically useful group.

The cyan coupler represented by the general formula (C) may form a polymer including a dimer or higher polymer at $R_a$ or $R_b$.

Specific examples of the cyan couplers represented by the general formula (C) described above are illustrated below, but the present invention is not to be construed as being limited to these compounds.

(C-1)

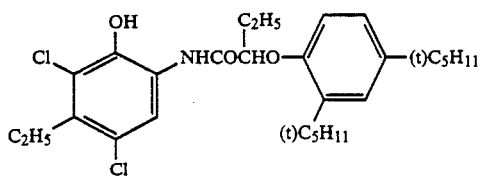

(C-2)

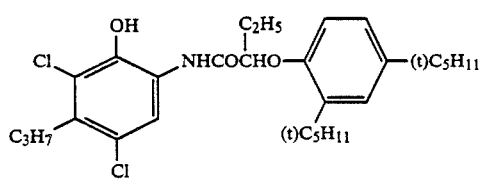

(C-3)

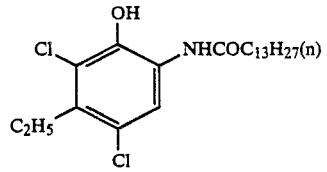

(C-4)

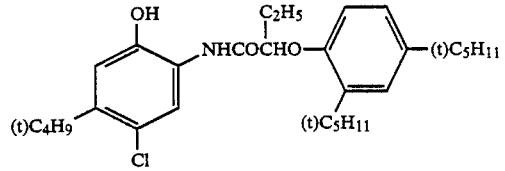

(C-5)

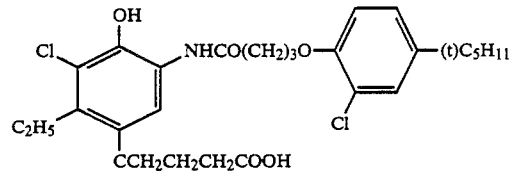

(C-6)

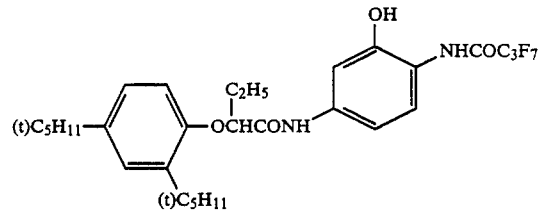

(C-7)

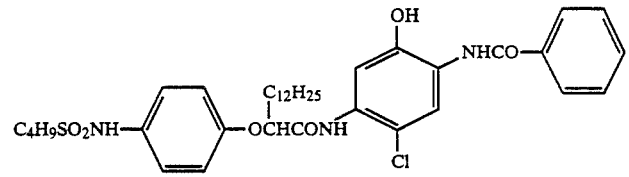

-continued
(C-8)
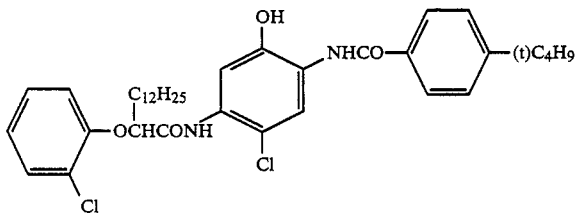
(C-9)
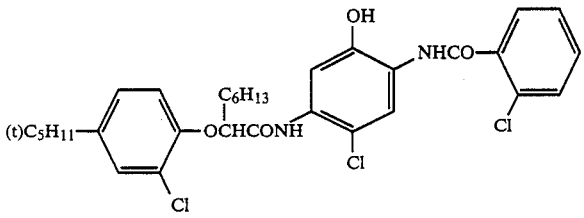
(C-10)
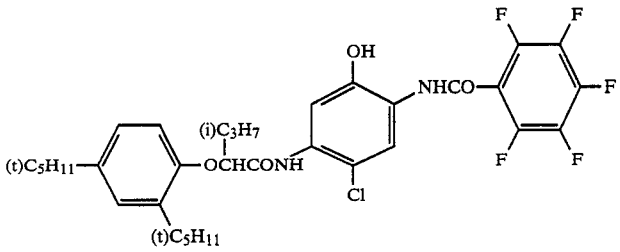
(C-11)
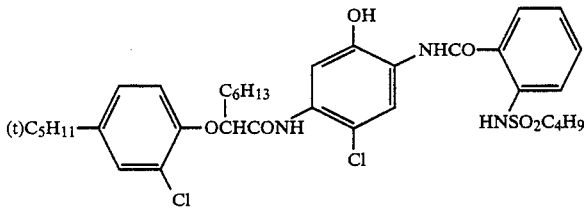
(C-12)
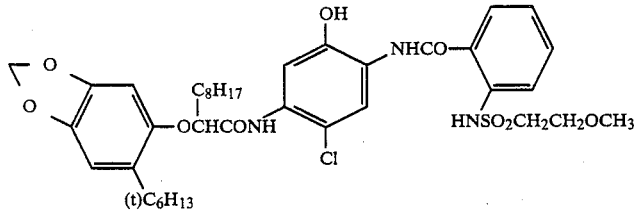
(C-13)
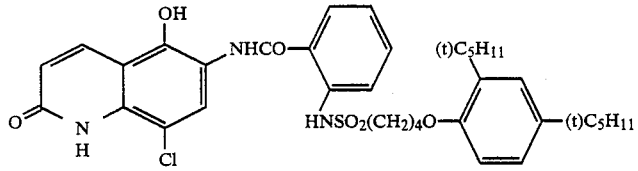
(C-14)
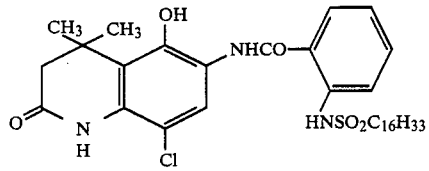

-continued
(C-15)
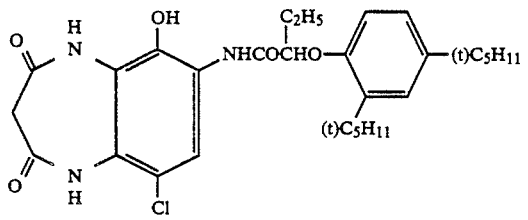
(C-16)
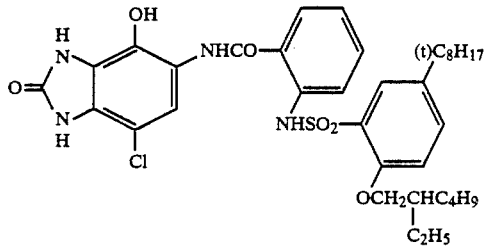
(C-17)
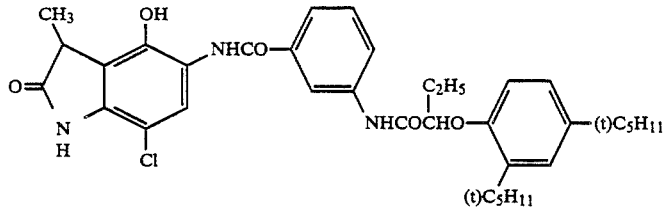
(C-18)
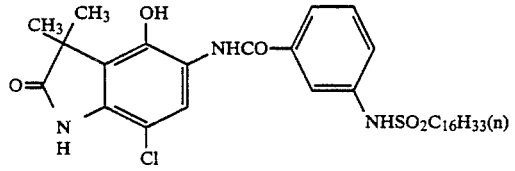
(C-19)
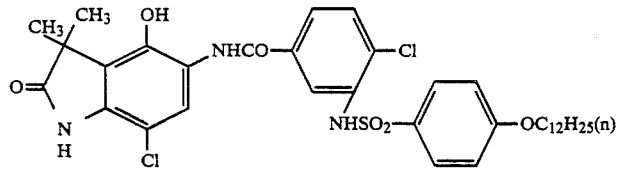
(C-20)
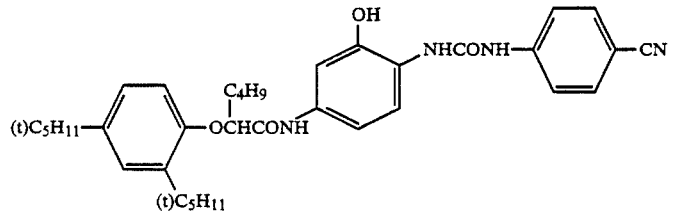
(C-21)
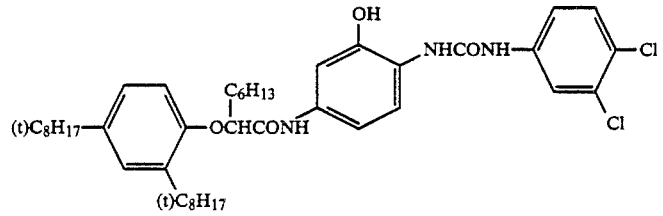

-continued (C-22)

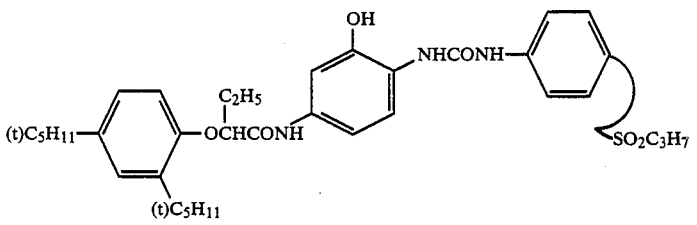

(C-23)

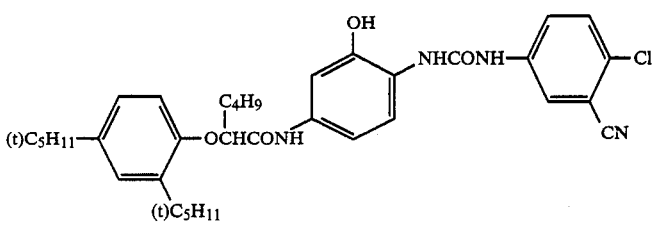

(C-24)

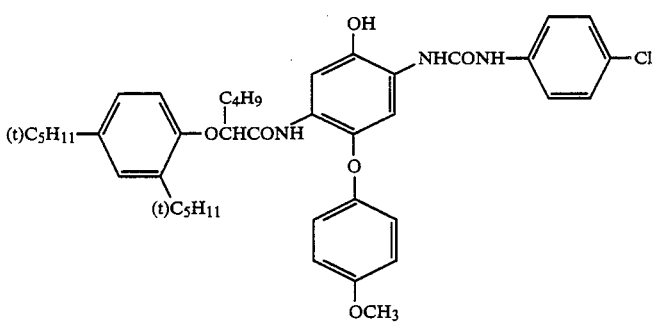

(C-25)

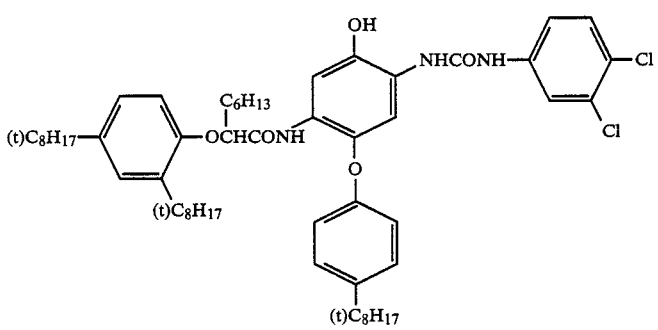

(C-26)

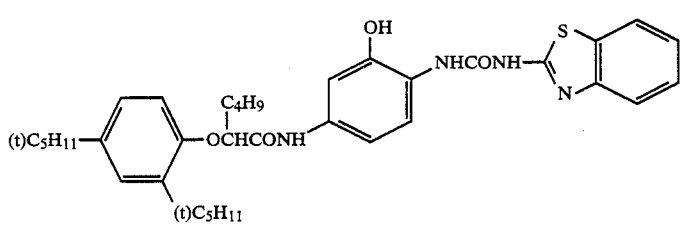

The cyan couplers represented by general formula (C) described above can be synthesized based on the methods as described, for example, in JP-A-No. 59-166956 and JP-B No.49-11572.

When the cyan coupler represented by general formula (C) above is employed in the present invention, the amount thereof is not particularly restricted, but preferably from $1\times10^{-6}$ mol to $1\times10^{-2}$ mol, and more preferably from $1\times10^{-5}$ mol to $1\times10^{-3}$ mol, per $m^2$ of the photographic light-sensitive material.

Further, couplers capable of forming appropriately diffusible dyes can be used together in order to improve graininess. Specific examples of such dye diffusible types of magenta couplers are described in U.S. Pat. No. 4,366,237 and British Patent No. 2,125,570, and those of yellow, magenta, and cyan couplers are described in European Patent No. 96,570 and West German Patent Application (OLS) No. 3,234,533.

These dye-forming couplers and special couplers described above may be used in the form of polymers including dimers or higher polymers. Typical examples of dye-forming polymer couplers are described in U.S. Pat. Nos. 3,451,820 and 4,080,211. Specific examples of magenta polymer couplers are described in British Patent No. 2,102,173 and U.S. Pat. No. 4,367,282.

Two or more kinds of couplers which can be used in the present invention can be incorporated together into the same layer for the purpose of satisfying the properties required of the color photographic light-sensitive materials, or the same compound can be incorporated into two or more different layers.

Couplers which can be used in the present invention may be introduced into the color photographic light-sensitive material using various known dispersing methods. Specific examples of organic solvents having a high boiling point which are employed for an oil-droplet-in-water type dispersing method are described in, for example, U.S. Pat. No. 2,322,027.

Further, the processes and effects of latex dispersing methods and specific examples of latices for loading are described in U.S. Pat. No. 4,199,363 and West German Patent Application (OLS) Nos. 2,541,274 and 2,541,230.

The color couplers are generally employed in an amount of from 0.001 mol to 1 mol per mol of the light-sensitive silver halide contained in a layer to be added. It is preferred that amounts of yellow couplers, magenta couplers, and cyan couplers used are in ranges of from 0.01 mol to 0.5 mol, from 0.003 mol to 0.3 mol, and from 0.002 mol to 0.3 mol, respectively, per mol of the light-sensitive silver halide.

The color photographic light-sensitive material used in the present invention is prepared by coating the photographic layers on a flexible support such as a plastic film (e.g., a cellulose nitrate film, a cellulose acetate film, or a polyethylene terephthalate film), paper, or a rigid support such as glass, each of which is conventionally employed. Suitable supports and coating methods are described in detail in *Research Disclosure,* Vol. 176, No. 17643, page 27, Item XV, page 28, Item XVII (December, 1979).

In the present invention, a reflective support is preferably used.

The term "reflective support" used herein means a support having increased reflectivity for the purpose of rendering dye images formed in the silver halide emulsion layer clear. Examples of the reflective support include a support having coated thereon a hydrophobic resin containing a light reflective substance such as titanium oxide, zinc oxide, calcium carbonate, or calcium sulfate dispersed therein and a support composed of a hydrophobic resin containing a light reflective substance dispersed therein.

In accordance with the method of processing a silver halide color photographic material of the present invention, the desilvering property is remarkably improved despite rapid processing, and further the formation of color stain is controlled and improved color restoration is achieved.

The present invention is now explained in greater detail with reference to the following examples, but the present invention is not to be construed as being limited thereto. Unless otherwise indicated, all parts, percents and ratios are by weight.

EXAMPLE 1

On a paper support, both surfaces of which were laminated with polyethylene were coated the layers as shown below to prepare a multilayer color printing paper, which was designated Sample A.

The coating solution was prepared by mixing and dissolving a silver halide emulsion, various chemicals and an emulsified dispersion of coupler. Methods for the preparation thereof are illustrated below.

Preparation of an emulsified dispersion of coupler 19.1 g of Yellow coupler (ExY), and 4.4 g of Dye image stabilizer (Cdp-1) were dissolved in 27.2 ml of ethyl acetate and 7.7 ml of Solvent (Solv-1). This solution was emulsified and dispersed in 185 ml of a 10% gelatin aqueous solution containing 8 ml of a 10% aqueous solution of sodium dodecylbenzenesulfonate.

In the same manner as described above, emulsions of a magenta coupler, a cyan coupler and for an intermediate layer were prepared respectively.

Methods for the preparation of silver halide emulsions used in this example are described below.

Blue-sensitive emulsion:

| | |
|---|---|
| Solution 1 | |
| $H_2O$ | 1,000 ml |
| NaCl | 5.5 g |
| Gelatin | 32 g |
| Solution 2 | |
| Sulfuric acid (1N) | 24 ml |
| Solution 3 | |
| Compound A (1%) of the formula: | 3 ml |

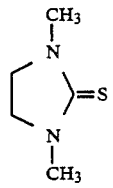

| | |
|---|---|
| Solution 4 | |
| NaCl | 1.7 g |
| $H_2O$ to make | 200 ml |
| Solution 5 | |
| $AgNO_3$ | 5 g |
| $H_2O$ to make | 200 ml |
| Solution 6 | |
| NaCl | 41.3 g |
| $K_2IrCl_6$ (0.001%) | 0.5 ml |
| $H_2O$ to make | 600 ml |
| Solution 7 | |
| $AgNO_3$ | 120 g |
| $H_2O$ to make | 600 ml |

Solution 1 was heated at 76° C., Solution 2 and Solution 3 were added thereto and then Solution 4 and Solution 5 were added simultaneously over a period of 10 minutes thereto. After 10 minutes, Solution 6 and Solution 7 were added simultaneously over a period of 35 minutes. After 5 minutes, the temperature was reduced and the mixture was desalted. Water and gelatin for dispersion were added thereto, and the pH was adjusted to 6.3, whereby a monodisperse cubic silver chloride emulsion (having an average grain size of 1.1 μm, a coefficient of variation [the value obtained by dividing the standard deviation by an average grain size: $S/\bar{d}$]: 0.10) was obtained.

To 1.0 kg of the resulting emulsion was added 26 ml of a 0.6% solution of spectral sensitizing dye for blue light (S-1). Then, a super fine grain silver bromide emulsion of 0.05 μm diameter was added thereto in a ratio of 0.5 mol % to the host silver chloride emulsion, and the mixture was ripened at 58° C. for 10 minutes. The emulsion was then subjected to an optimum chemical sensitization using sodium thiosulfate, and $10^{-4}$ mol of stabilizer (Stb-1) per mol of silver was added thereto.

Green-sensitive emulsion:

| | |
|---|---|
| Solution 8 | |
| $H_2O$ | 1000 ml |
| NaCl | 3.3 g |
| Gelatin | 32 g |
| Solution 9 | |
| Sulfuric acid (1N) | 24 ml |
| Solution 10 | |
| Compound A (1%) | 3 ml |
| Solution 11 | |
| NaCl | 11.00 g |
| $H_2O$ to make | 200 ml |
| Solution 12 | |
| $AgNO_3$ | 32.00 g |
| $H_2O$ to make | 200 ml |
| Solution 13 | |
| NaCl | 44.00 g |
| $K_2IrCl_6$ (0.001%) | 2.3 ml |
| $H_2O$ to make | 560 ml |
| Solution 14 | |
| $AgNO_3$ | 128 g |
| $H_2O$ to make | 560 ml |

Solution 8 was heated at 52° C., Solution 9 and Solution 10 were added thereto. Then, Solution 11 and Solution 12 were added simultaneously over a period of 14 minutes thereto, and after 10 minutes Solution 13 and Solution 14 were added simultaneously thereto over a period of 15 minutes.

To the emulsion was added $4\times10^{-4}$ mol of Sensitizing dye (S-2) per mol of silver halide, and then Solution 15 described below was added thereto over a period of 10 minutes. After 5 minutes, the temperature was reduced and the mixture has desalted. Water and gelatin for dispersion were added thereto and the pH was adjusted to 6.2.

| Solution 15 | |
|---|---|
| KBr | 5.60 g |
| $H_2O$ to make | 280 ml |

The emulsion was subjected to an optimum chemical sensitization using sodium thiosulfate at 58° C. whereby a monodisperse cubic silver chloride emulsion (having an average grain size of 0.48 μm, a coefficient of variation [a value obtained by dividing the standard deviation by an average grain size: $S/\bar{d}$]: 0.10) was obtained. Further, $5\times10^{-4}$ mol of Stabilizer (Stb-1) per mol of silver halide was added thereto.

The red-sensitive emulsion was prepared in the same manner as described for the preparation of the green-sensitive emulsion except using $1.5\times10^{-4}$ mol of Sensitizing dye (S-3) per mol of silver halide in place of Sensitizing dye (S-2).

Construction of Layers

The compositions of the layers are described below. The coated amounts are indicated in terms of g/m², provided that the coated amounts of the silver halide emulsions are indicated in terms of g silver/m².

Support:

Polyethylene laminated paper support in which the polyethylene on the First Layer side contained a white pigment ($TiO_2$) and a blueish dye (ultramarine).

| First Layer: Blue-sensitive Layer | |
|---|---|
| Silver halide emulsion | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Second Layer: Color-mixing Preventing Layer | |
| Gelatin | 0.99 |
| Color mixing preventing agent (Cpd-2) | 0.08 |
| Third Layer: Green-sensitive Layer | |
| Silver halide emulsion | 0.36 |
| Gelatin | 1.24 |
| Magenta coupler (ExM-1) | 0.31 |
| Color image stabilizer (Cpd-3) | 0.25 |
| Color image stabilizer (Cpd-4) | 0.12 |
| Solvent (Solv-2) | 0.42 |
| Fourth Layer: Ultraviolet Light Absorbing Layer | |
| Gelatin | 1.58 |
| Ultraviolet light absorbing agent (UV-1) | 0.62 |
| Color mixing preventing agent (Cpd-5) | 0.05 |
| Solvent (Solv-3) | 0.24 |
| Fifth Layer: Red-sensitive Layer | |
| Silver halide emulsion | 0.23 |
| Gelatin | 1.34 |
| Cyan coupler (ExC-1) | 0.34 |
| Color image stabilizer (Cpd-6) | 0.17 |
| Polymer (Cpd-7) | 0.40 |
| Solvent (Solv-4) | 0.23 |
| Sixth Layer: Ultraviolet light Absorbing Layer | |
| Gelatin | 0.53 |
| Ultraviolet light absorbing agent (UV-1) | 0.21 |
| Solvent (Solv-3) | 0.01 |
| Seventh Layer: Protective Layer | |
| Gelatin | 1.33 |
| Acryl-modified polyvinyl alcohol copolymer (modification degree: 17%) | 0.17 |
| Liquid paraffin | 0.03 |

1-oxy-3,5-dichloro-s-triazine sodium salt was used in each layer as a hardener.

The compounds employed are illustrated below.

(ExY) Yellow Coupler:

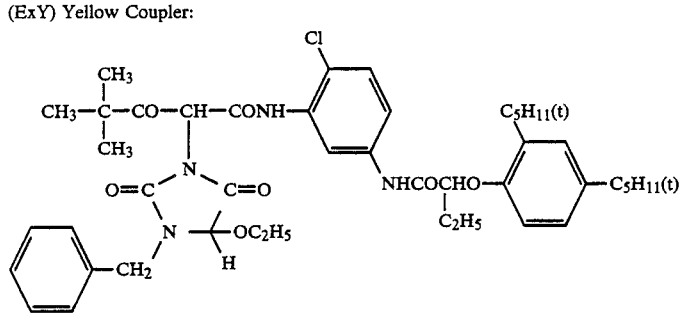

(ExM-1) Magenta Coupler:

-continued
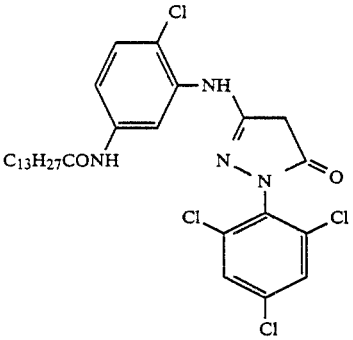
(ExC-1) Cyan Coupler:
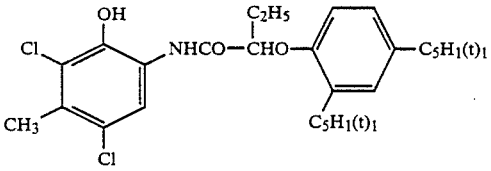
(Cpd-1) Color Image Stabilizer:
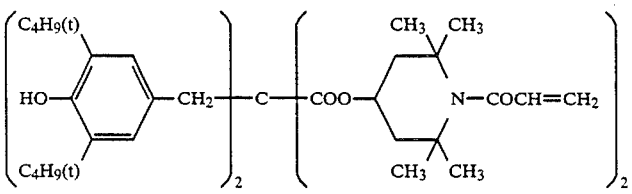
(Cpd-2) Color Mixing Preventing Agent:
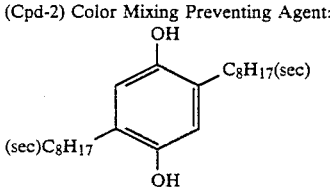
(Cpd-3)
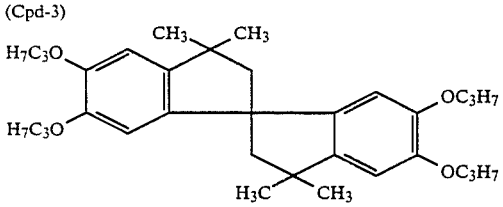
(Cpd-4)
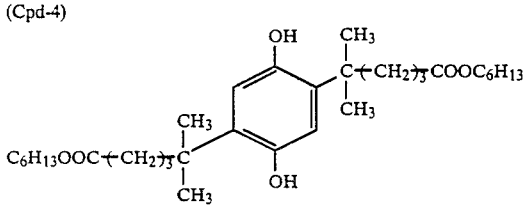
(Cpd-5) Color Mixing Preventing Agent:
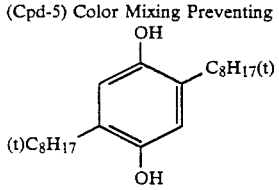
(Cpd-6) Color Image Stabilizer:
A mixture of -continued

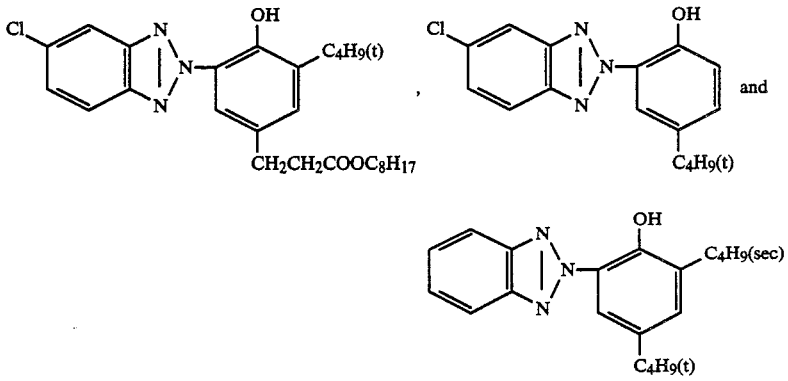

in a ratio of 5:9:8: by weight.

(Cpd-7) Polymer:

$$\left(CH_2-\underset{\underset{CONHC_4H_9(t)}{|}}{CH}\right)_n$$

Average molecular weight: 80,000

(UV-1) Ultraviolet Light Absorbing Agent:
A mixture of

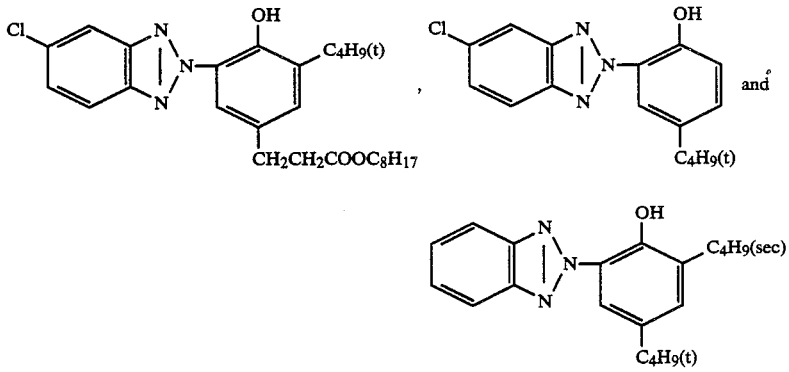

in a ratio of 2:9:8: by weight.

(Solv-1) Solvent:

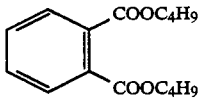

(Solv-2) Solvent:
$O{=}P(O-C_8H_{17}(iso))_3$ (Solv-3) Solvent:
$O{=}P(O-C_9H_{19}(iso))_3$ (Solv-4) Solvent:

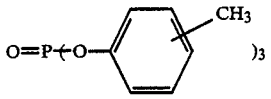

For preventing irradiation, the dyes described below were added to the red-sensitive and green-sensitive emulsion layers.

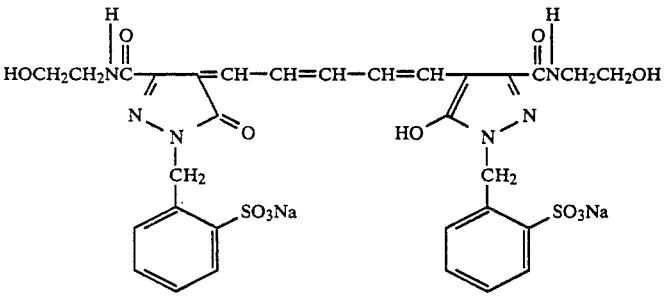
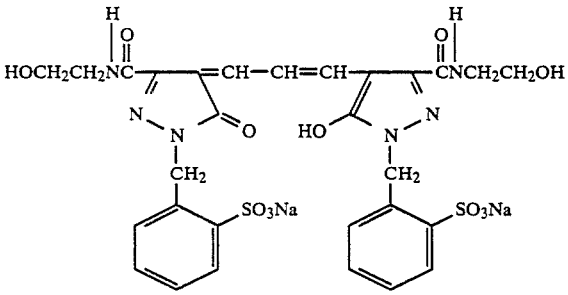
To the red-sensitive emulsion layer, was added the compound shown below in an amount of $2.6\times10^{-3}$ mol per mol of silver halide.
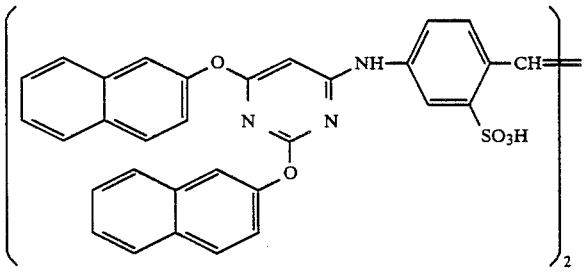
(S-1) Sensitizing Dye:
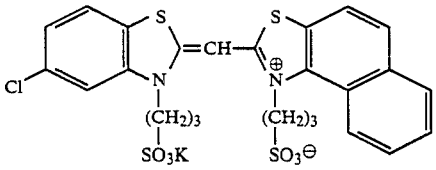
(S-2) Sensitizing Dye:
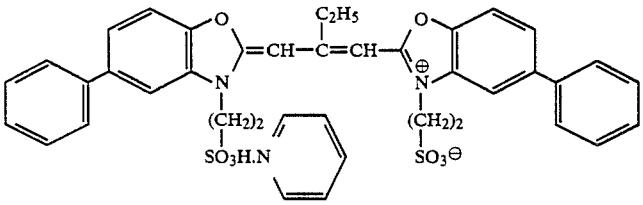
(S-3) Sensitizing Dye:
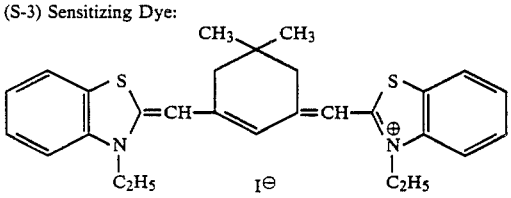

-continued (Stb-1) Stabilizer:

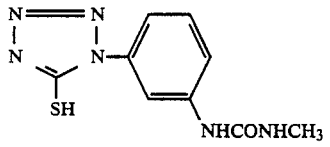

The silver halide color photographic material (Sample A) thus prepared was exposed to light through a wedge and then subjected to development processing according to the following processing steps.

| Processing Steps | Temperature | Time |
|---|---|---|
| Color Development | 35° C. | 45 sec |
| Bleach-Fixing | 30 to 35° C. | 30 sec |
| Rinse (1) | 30 to 35° C. | 20 sec |
| Rinse (2) | 30 to 35° C. | 20 sec |
| Rinse (3) | 30 to 35° C. | 20 sec |
| Drying | 70 to 80° C. | 60 sec |

The rinse steps were conducted using a three-tank countercurrent system from Rinse (3) to Rinse (1).

The composition of each processing solution used was as follows.

| Color Developing Solution: | |
|---|---|
| Water | 800 ml |
| Ethylenediamine N,N,N',N'-tetramethylene phosphonic acid | 1.5 g |
| Preservative | shown in Table 1 below |
| Sodium chloride | 1.4 g |
| Potassium carbonate | 25.0 g |
| N-Ethyl-N-(β-methanesulfonamidoethyl)-3-methyl-4-aminoanaline sulfate | 5.5 g |
| N,N-Diethylhydroxylamine | 4.2 g |
| Fluorescent brightening agent (UVITEX-CK manufactured by Ciba-Geigy Co.) | 2.5 g |
| Water to make | 1000 ml |
| pH (25° C.) | 10.10 |
| Bleach-Fixing Solution: | |
| Water | 400 ml |
| Ammonium thiosulfate (70%) | 100 ml |
| Sodium sulfite | 18 g |

-continued

| | |
|---|---|
| Ammonium ethylenediaminetetraacetato iron (III) | 55 g |
| Disodium ethylenediaminetraacetate | 3 g |
| Halide | shown in Table 1 below |
| Color developing solution described above | 150 ml |
| Glacial acetic acid | 8 g |
| Water to make | 1000 ml |
| pH | 6.0 |

Rinse Solution:

Ion exchange water (contents of calcium and magnesium each not more than 3 ppm).

The amount of remaining silver in the maximum density area of the sample thus processed was determined according to X-ray fluorometric analysis. Further, the yellow reflective density in the minimum density area of the sample was measured using a Macbeth densitometer.

The cyan reflective density in the $D_{max}$ area of the sample just after processing was measured, then the samples were immersed in a bleach replenisher for color negative film (CN-16, $N_2$-R manufactured by Fuji Photo Film Co,. Ltd.) at room temperature for 4 minutes, followed by washing and drying, and thereafter the cyan reflective density of the sample was again measured, whereby a cyan color forming rate was obtained, which was defined as follows.

Cyan color forming rate (%)=Cyan density just after processing/Cyan density after re-bleaching×100

The results thus obtained are shown in Table 1 below.

TABLE 1

| No. | Preservative | Amount Added (mol/l) | Halide | Amount Added (mol/l) | Amount of Remaining Silver (μg/cm²) | $D_B$ min | Cyan Color Forming Rate (%) | Remark |
|---|---|---|---|---|---|---|---|---|
| 1 | Sodium Sulfite | 0.015 | — | — | 17 | 0.10 | 93 | Comparison |
| 2 | — | — | — | — | 16 | 0.16 | 95 | " |
| 3 | Sodium Sulfite | 0.1 | $NH_4Br$ | 0.3 | 9 | 0.09 | 94 | " |
| 4 | " | 0.02 | " | " | 10 | 0.09 | 94 | " |
| 5 | — | — | " | $0.5 \times 10^{-2}$ | 15 | 0.14 | 95 | " |
| 6 | — | — | " | $3 \times 10^{-2}$ | 27 | 0.14 | 95 | " |
| 7 | — | — | KI | $3 \times 10^{-4}$ | 15 | 0.14 | 95 | " |
| 8 | — | — | $NH_4Br$ | 0.3 | 4 | 0.08 | 99 | Present Invention |
| 9 | — | — | " | 2.0 | 6 | 0.08 | 98 | Present Invention |
| 10 | VII-1 | 0.1 | " | 0.3 | 4 | 0.06 | 100 | Present Invention |
| 11 | VIII-1 | " | " | " | 4 | 0.07 | 100 | Present Invention |
| 12 | XI-2 | " | " | " | 3 | 0.07 | 100 | Present Invention |
| 13 | XVI-1 | " | " | " | 4 | 0.06 | 100 | Present Invention |
| 14 | XVI-7 | " | " | " | 4 | 0.06 | 100 | Present Invention |
| 15 | XVI-7 | 0.1 | $NH_4Br$ | 1.0 | 6 | 0.07 | 100 | Present |

TABLE 1-continued

| No. | Preservative | Amount Added (mol/l) | Halide | Amount Added (mol/l) | Amount of Remaining Silver ($\mu g/cm^2$) | $D_B$ min | Cyan Color Forming Rate (%) | Remark |
|---|---|---|---|---|---|---|---|---|
| 16 | — | — | KI | $1 \times 10^{-3}$ | 7 | 0.08 | 99 | Invention Present Invention |
| 17 | VII-1 | 0.1 | " | " | 7 | 0.07 | 100 | Present Invention |

From the results shown in Table 1 above, it is apparent that when a sulfite ion was absent in the color developing solution, color stain increased while the desilvering property was substantially not affected (No. 2). On the other hand, when sulfite ions were present, effects of the addition of halide on $D_B$ min and cyan color forming property are slight, although the effect on desilvering properties is recognized (Nos. 3 and 4). Further, when the amount of halide added is out of the range of the present invention, preferred results were not obtained. In contrast according to the methods of the present invention superior photographic properties were obtained. Particularly, excellent properties were achieved by using the preservatives according to the present invention (Nos. 10, 11, 12, 13, 14 and 15).

EXAMPLE 2

Similar excellent results to those above were obtained using VII-3, VII-5, VIII-2, VIII-5, IX-2, X-2, XI-3, XII-1, XIII-1, XIV-2, XV-1, and XVI-2 in place of the preservative VII-1 in No. 10 of Example 1 respectively.

EXAMPLE 3

Sample A as prepared in Example 1 was imagewise exposed to light and continuously processed (a running test) according to the processing steps shown below, with the compositions of the color developing solution and the bleach-fixing solution being varied as shown in Table 2 below using a processor for paper, until the amount of the replenisher for the color developing solution reached twice the capacity of the developing tank.

| Processing Step | Temperature | Time | Amount of* Replenisher | Capacity of Tank |
|---|---|---|---|---|
| Color Development | 35° C. | 45 sec | 161 ml | 17 l |
| Bleach-Fixing | 30 to 36° C. | 20 sec | 200 ml | 17 l |
| Stabilizing (1) | 30 to 37° C. | 20 sec | — | 10 l |
| Stabilizing (2) | 30 to 37° C. | 20 sec | — | 10 l |
| Stabilizing (3) | 30 to 37° C. | 20 sec | — | 10 l |
| Stabilizer (4) | 30 to 37° C. | 30 sec | 200 ml | 10 l |
| Drying | 70 to 85° C. | 60 sec | | |

*Amount of replenisher is indicated as an amount per $m^2$ of the photographic light-sensitive material.

The stabilizing steps were conducted using a four-tank countercurrent system from Stabilizing (4) to Stabilizing (1).

The composition of each processing solution used was as follows:

| Color Developing Solution | Tank Solution | Replenisher |
|---|---|---|
| Water | 800 ml | 800 ml |
| Ethylenediaminetetraacetate | 2.0 g | 2.0 g |
| 5,6-Dihydroxybenzene-1,2,4-trisulfonic acid | 0.3 g | 0.3 g |
| Preservative | shown in Table 2 below | |
| Sodium chloride | 1.4 g | — |

-continued

| | | |
|---|---|---|
| Potassium carbonate | 25 g | 25 g |
| N-Ethyl-N-(β-methanesulfonamidoethyl)-3-methyl-4-aminoanaline sulfate | 5.0 g | 7.0 g |
| Diethylhydroxylamine | 4.2 g | 6.0 g |
| Fluorescent brightening agent (4,4'-diaminostilbene type) | 2.0 g | 2.5 g |
| Water to make | 1,000 ml | 1,000 ml |
| pH (25° C.) | 10.05 | 10.45 |

Bleach-Fixing Solution (Both Tank Solution and Replenisher)

| | |
|---|---|
| Water | 400 ml |
| Ammonium thiosulfite (70%) | 100 ml |
| Sodium sulfite | 17 g |
| Ammonium ethylenediaminetetraacetato iron (III) | 55 g |
| Disodium ethylenediaminetetraacetate | 5 g |
| Glacial acetic acid | 9 g |
| Halide | Shown in Table 2 below |
| Water to make | 1,000 ml |
| pH (25° C.) | 5.40 |

Stabilizing Solution:

| | |
|---|---|
| 1-Hydroxyethylidene-1,1-diphosphonic acid (60%) | 1.6 ml |
| Bismuth chloride | 0.3 g |
| Aqueous ammonia (26%) | 2.5 ml |
| Nitrilotriacetic acid | 1.0 g |
| 5-chloro-2-methyl-4-isothiazolin-3-one | 0.05 g |
| 2-Octyl-4-isothiazolin-3-one | 0.05 g |
| Fluorescent brightening agent (4,4'-diaminostilbene type) | 1.0 g |
| Water to make | 1,000 ml |
| pH (25° C.) | 7.5 |

Samples B to F were prepared in the same manner as described for Sample A except for changing the cyan coupler to those shown below respectively.

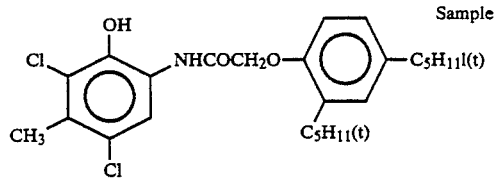

Sample B

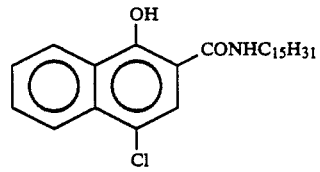

Sample C

C-2 Sample D

C-3 Sample E

C-9 Sample F

Samples A to F were exposed to light through a wedge at 250 CMS and then subjected to development processing using the above described running solutions respectively.

The amount of remaining silver in the maximum density area of the sample thus processed was determined according to X-ray fluorometric analysis. Further, the yellow reflective density in the minimum density area of the sample was measured using a Macbeth densitometer.

The cyan reflective density in the $D_{max}$ area of the sample just after processing was measured, then the samples were immersed in a bleach replenisher (CN-16, $N_2$-R manufactured by Fuji Photo Film Co., Ltd.) at room temperature for 4 minutes, followed by washing and drying, and thereafter cyan reflective density of the sample was again measured, whereby a cyan color forming rate was obtained, which was defined as follows.

Cyan color forming rate (%) = Cyan density just after processing/Cyan density after re-bleaching × 100

The results thus-obtained are shown in Table 2 below.

TABLE 2

| Processing | [I] (Comparison) | | | [II] (Comparison) | | | [III] (Present Invention) | | | [IV] (Present Invention) | | | [V] (Present Invention) | | |
|---|---|---|---|---|---|---|---|---|---|---|---|---|---|---|---|
| Preservative | — | | | Sodium sulfite | | | — | | | Triethanolamine | | | — | | |
| (mol/l) | | | | 0.02 | | | | | | 0.1 | | | | | |
| Halide | — | | | $NH_4Br$ | | | $NH_4Br$ | | | $NH_4Br$ | | | KI | | |
| (mol/l) | | | | 0.3 | | | 0.3 | | | 0.3 | | | $1 \times 10^{-3}$ | | |
| | (1) | (2) | (3) | (1) | (2) | (3) | (1) | (2) | (3) | (1) | (2) | (3) | (1) | (2) | (3) |
| Sample A | 19 | 0.13 | 90 | 13 | 0.12 | 91 | 10 | 0.10 | 95 | 10 | 0.10 | 95 | 11 | 0.10 | 95 |
| Sample B | 18 | 0.14 | 90 | 13 | 0.12 | 91 | 11 | 0.10 | 95 | 10 | 0.10 | 95 | 11 | 0.10 | 95 |
| Sample C | 21 | 0.14 | 85 | 14 | 0.11 | 86 | 11 | 0.10 | 91 | 10 | 0.10 | 92 | 11 | 0.10 | 92 |
| Sample D | 18 | 0.13 | 91 | 14 | 0.11 | 91 | 6 | 0.08 | 100 | 5 | 0.07 | 100 | 6 | 0.08 | 100 |
| Sample E | 17 | 0.13 | 92 | 13 | 0.11 | 93 | 4 | 0.08 | 100 | 4 | 0.07 | 100 | 6 | 0.08 | 100 |
| Sample F | 17 | 0.13 | 95 | 13 | 0.11 | 95 | 5 | 0.08 | 100 | 5 | 0.07 | 100 | 5 | 0.08 | 100 |

(1) Amount of remaining silver ($\mu g/cm^2$)
(2) $D_B$ min
(3) Color forming rate (%)

From the results shown in Table 2 above, it can be seen that when the cyan coupler represented by the general formula (C) was employed and the processing according to the present invention was conducted, more excellent results in desilvering property color stain and color forming property were obtained.

EXAMPLE 4

Sample D as prepared in Example 3 was processed in the same manner as described in Example 3 except using the preservative and halide as shown Table 3 below. Superior results were obtained.

TABLE 3

| Processing | Preservative | Amount Added (mol/l) | Halide | Amount Added (mol/l) |
|---|---|---|---|---|
| [VI] | — | — | $NH_4Br$ | 1.0 |
| [VII] | — | — | KBr | 0.2 |
| [VIII] | DABCO*1 | 0.1 | $NH_4Br$ | 0.2 |
| [IX] | — | — | KI | $5 \times 10^{-4}$ |
| [X] | — | — | KI | $1 \times 10^{-3}$ |
| [XI] | — | — | KI | $1 \times 10^{-2}$ |
| [XII] | MeDABCO*2 | 0.1 | KI | " |
| [XIII] | Triethanolamine | 0.1 | KI | " |

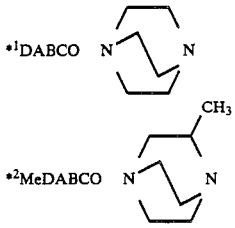

EXAMPLE 5

On a paper support, both surfaces of which were laminated with polyethylene, were coated the layers as shown below to prepare a multilayer photographic printing paper, which was designated Sample G. The coating solutions were prepared as follows.

Preparation of the coating solution for the First Layer 10.2 g of Yellow coupler (ExY-1'), 9.1 g of Yellow coupler (ExY-2'), and 4.4 g of Color image stabilizer (Cpd-1') were dissolved in 27.2 ml of ethyl acetate and 7.7 ml (8.0 g) of High boiling point solvent (Solv-1'). This solution was emulsified and dispersed in 185 ml of a 10% gelatin aqueous solution containing 8 ml of a 10% aqueous solution of sodium dodecylbenzenesulfonate. Emulsions (EM1) and (EM2) described hereinafter were mixed with thus-obtained emulsified dispersion, and the gelatin concentration was adjusted to obtain the coating solution for the First Layer.

The coating solutions for the Second to Seventh Layers were prepared in the same manner as described for the coating solution for the First Layer. In each layer, 1-oxy-3,5-dichloro-s-triazine sodium salt was used as a gelatin hardener. Further, Viscosity imparting agent (Cpd-2') was used in the coating solutions.

Construction of Layers

The compositions of the layers are described below. The coated amount are indicated in terms of $g/m^2$ provided that the coated amounts of the silver halide emulsions are indicated in terms of g silver/$m^2$ Support:

Polyethylene laminated paper support in which the polyethylene on the First Layer side contained a white pigment ($TiO_2$) and a blueish dye.

| | |
|---|---|
| First Layer: Blue-sensitive Layer | |
| Monodisperse silver chlorobromide emulsion (EM1) spectrally sensitized with Sensitizing dye (ExS-1') | 0.13 |
| Monodisperse silver chlorobromide emulsion (EM2) spectrally sensitized with Sensitizing dye (ExS-1') | 0.13 |
| Gelatin | 1.86 |
| Yellow coupler (ExY-1') | 0.44 |
| Yellow coupler (ExY-2') | 0.39 |
| Color image stabilizer (Cpd-1') | 0.19 |
| Solvent (Solv-1') | 0.35 |
| Second Layer: Color-mixing Preventing Layer | |
| Gelatin | 0.99 |
| Color mixing preventing agent (Cpd-3') | 0.08 |
| Third Layer: Green-sensitive Layer | |
| Monodisperse silver chlorobromide emulsion (EM3) spectrally sensitized with Sensitizing dyes (ExS-2', 3') | 0.05 |
| Monodisperse silver chlorobromide emulsion (EM4) spectrally sensitized with Sensitizing dyes (ExS-2', 3') | 0.11 |
| Gelatin | 1.80 |
| Magenta coupler (ExM-1') | 0.39 |
| Color image stabilizer (Cpd-4') | 0.20 |
| Color image stabilizer (Cpd-5') | 0.02 |
| Color image stabilizer (Cpd-6') | 0.03 |
| Solvent (Solv-2') | 0.12 |
| Solvent (Solv-3') | 0.25 |
| Fourth Layer: Ultraviolet Light Absorbing Layer | |
| Gelatin | 1.60 |
| Ultraviolet light absorbing agent (Cpd-7'/Cpd-8'/Cpd-9' = 3/2/6 by weight ratio) | 0.70 |
| Color mixing preventing agent (Cpd-10') | 0.05 |
| Solvent (Solv-4') | 0.27 |
| Fifth Layer: Red-sensitive Layer | |
| Monodisperse silver chlorobromide emulsion (EM5) spectrally sensitized with Sensitizing dyes (ExS-4', 5') | 0.07 |
| Monodisperse silver chlorobromide emulsion (EM6) spectrally sensitized with Sensitizing dyes (ExS-4', 5') | 0.16 |
| Gelatin | 0.92 |
| Cyan coupler (ExC-1') | 0.32 |

-continued

| | |
|---|---|
| Color image stabilizer (Cpd-8'/Cpd-9'/Cpd-12' = 3/4/2/by weight ratio) | 0.17 |
| Polymer for dispersion (Cpd-11') | 0.28 |
| Solvent (Solv-2') | 0.20 |
| Sixth Layer: Ultraviolet Light Absorbing Layer | |
| Gelatin | 0.54 |
| Ultraviolet light absorbing agents (Cpd-7'/Cpd-9'/Cpd-12' = 1/5/3 by weight ratio) | 0.21 |
| Solvent (Solv-2') | 0.08 |
| Seventh Layer: Protective Layer | |
| Gelatin | 1.33 |
| Acryl-modified polyvinyl alcohol copolymer (modification degree: 17%) | 0.17 |
| Liquid Paraffin | 0.03 |

For preventing irradiation, Irradiation Preventing Dyes (Cpd-I3', 14') were used.

To all the layers, Alkanol B (Du pont), sodium alkylbenzenesulfonate, succinic acid ester, and Megafacx F-120 (Dai Nippon Ink and Chemical Co., Ltd.) were added as an emulsifying dispersing agent and a coating aid.

For stabilizing silver halide, Silver halide stabilizers (Cpd-15', 16') were used.

The silver halide emulsions used in this example are described below.

| Emulsion | Crystal form | Grain size (μm) | Bromide content (mol %) | Coefficient of variation |
|---|---|---|---|---|
| EM1 | cubic | 1.0 | 80 | 0.08 |
| EM2 | cubic | 0.75 | 80 | 0.07 |
| EM3 | cubic | 0.5 | 83 | 0.09 |
| EM4 | cubic | 0.4 | 83 | 0.10 |
| EM5 | cubic | 0.5 | 73 | 0.09 |
| EM6 | cubic | 0.4 | 73 | 0.10 |

The compounds used in this example are illustrated below.

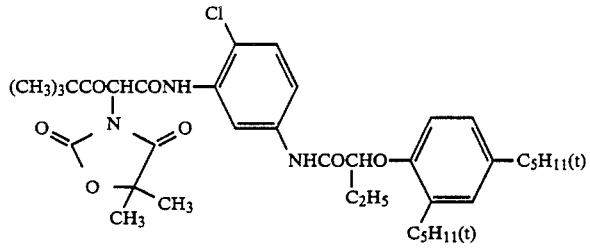

ExY-1'

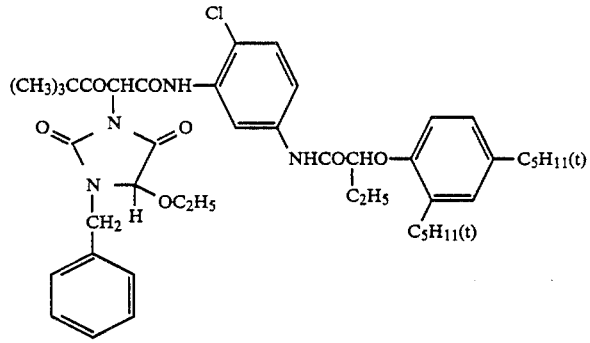

ExY-2'

-continued
ExM-1'
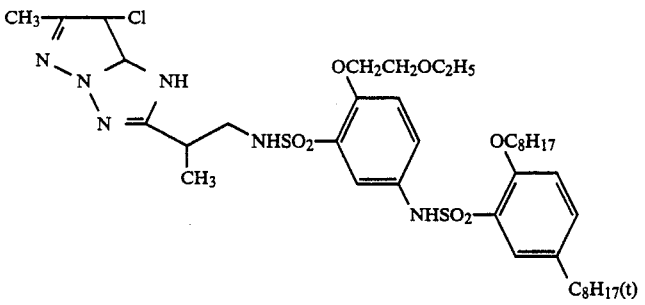
ExC-1'
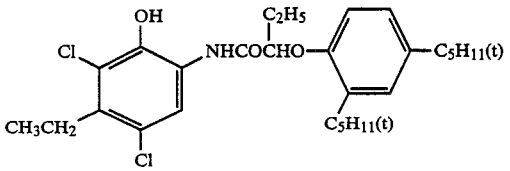
ExS-1'
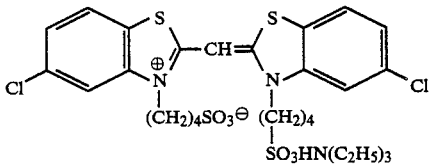
ExS-2'
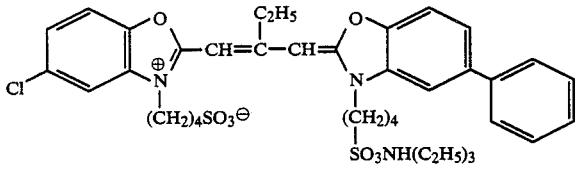
ExS-3'
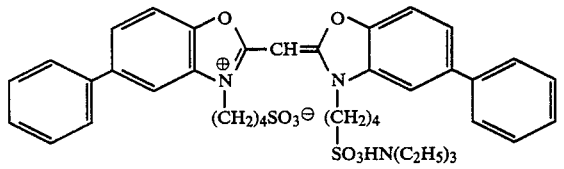
ExS-4'
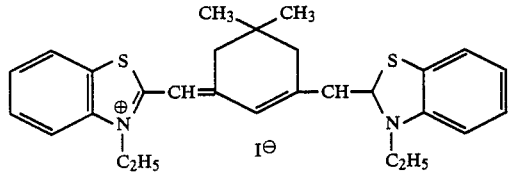
ExS-5'
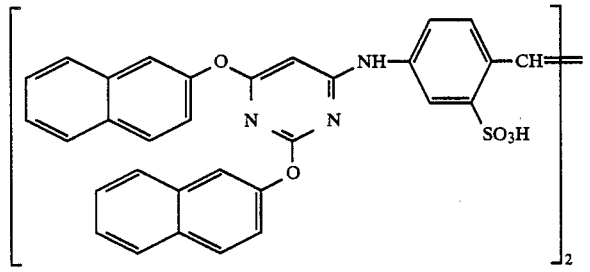

-continued
Cpd-1'
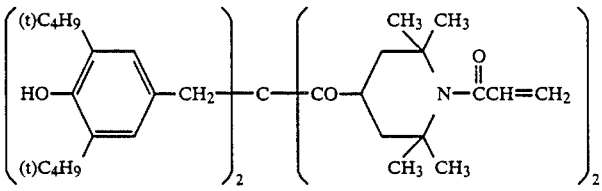
Cpd-2'
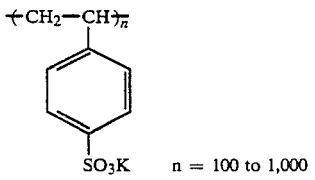
n = 100 to 1,000
Cpd-3'
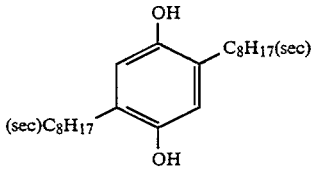
Cpd-4'
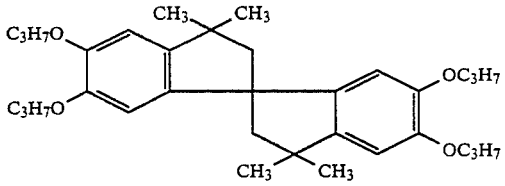
Cpd-5'
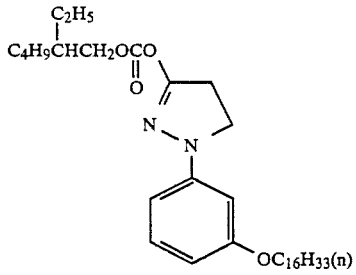
Cpd-6'
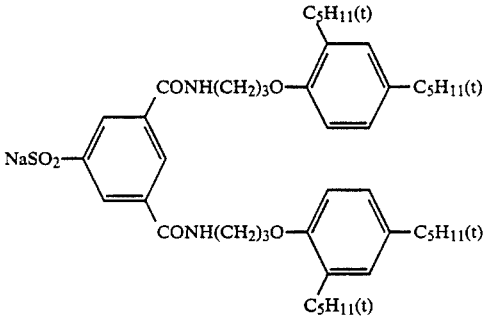
Cpd-7'
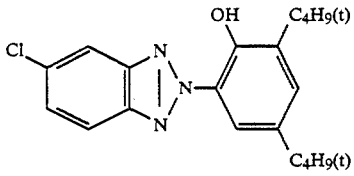

-continued
Cpd-8′
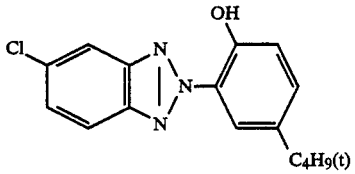
Cpd-9′
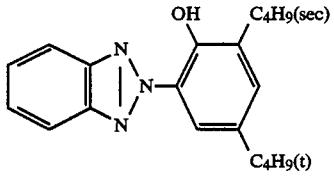
Cpd-10′
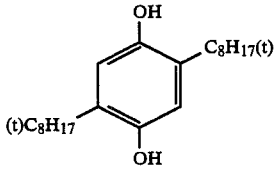
Cpd-11′
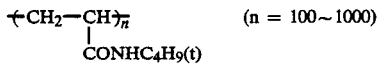
Cpd-12′
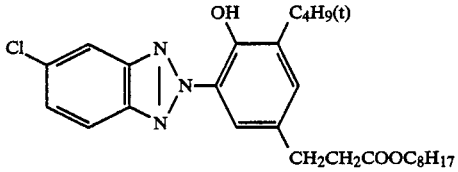
Cpd-13′
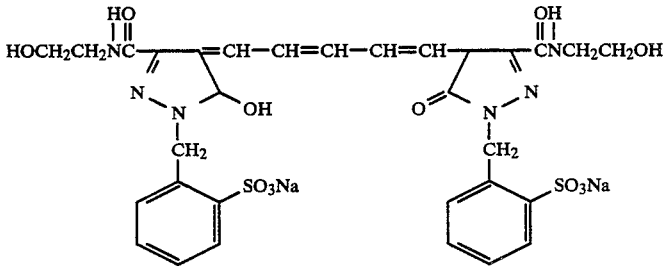
Cpd-14′
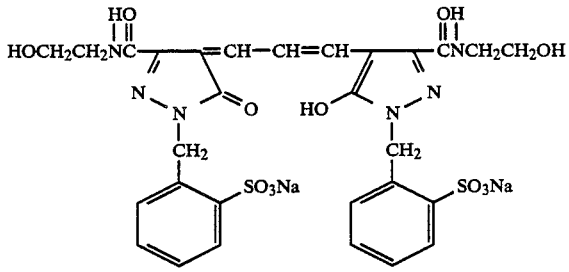
Cpd-15′
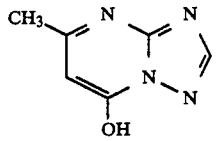
Cpd-16′
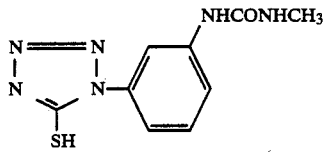

-continued

| | |
|---|---|
| Dibutyl phthalate | Solv-1' |
| Tricresyl phosphate | Solv-2' |
| Trioctyl phosphate | Solv-3' |
| Trinonyl phosphate | Solv-4' |

The color photographic light-sensitive material thus prepared was imagewise exposed to light and continuously processed (a running test) according to the processing steps shown below, with the compositions of the color developing solution and the bleach-fixing solution being varied as shown in Table 4 below using a Fuji Color Paper Processor PP600, until the amount of the replenisher for the color developing solution reached twice the capacity of the developing tank, and thereby running solution were prepared.

| Processing Step | Temperature (°C.) | Time | Amount of* Replenisher | Capacity of Tank |
|---|---|---|---|---|
| Color Development | 38 | 1'40" | 290 ml | 17 l |
| Bleach-Fixing | 35 | 60" | 180 ml | 9 l |
| Rinse (1) | 33 to 35 | 20" | — | 4 l |
| Rinse (2) | 33 to 35 | 20" | — | 4 l |
| Rinse (3) | 33 to 35 | 20" | 250 ml | 4 l |
| Drying | 70 to 80 | 50" | | |

*Amount of replenisher is indicated as an amount per $m^2$ of the photographic light-sensitive material.

The rinse steps were conducted using a three-tank countercurrent system from Rinse (3) to Rinse (1).

The composition of each processing solution used was as follows:

| | Tank Solution | Replenisher |
|---|---|---|
| Color Developing Solution | | |
| Water | 800 ml | 800 ml |
| Diethylenetriaminepentaacetic acid | 1.0 g | 1.0 g |
| Nitrilotrimethylenephosphonic acid | 2.0 g | 2.0 g |
| 1-Hydroxyethylidene-1,1-diphosphoric acid | 2.0 g | 2.0 g |
| Benzyl alcohol | shown in Table 4 below | |
| Diethylene glycol | 10 ml | 10 ml |
| Preservative | shown in Table 4 below | |
| Potassium bromide | 0.5 g | — |
| Potassium carbonate | 30 g | 30 g |

-continued

| | Tank Solution | Replenisher |
|---|---|---|
| N-Ethyl-N-(β-methanesulfonamidoethyl)-3-methyl-4-aminoaniline sulfate | 5.5 g | 7.5 g |
| Hydroxylamine sulfate | 2.0 g | 2.5 g |
| Fluorescent brightening agent (WHITEX 4, manufactured by Sumitomo Chemical Co., Ltd.) | 1.5 g | 2.0 g |
| Water to make | 1,000 ml | 1,000 ml |
| pH at 25° C. | 10.20 | 10.60 |
| Bleach-Fixing Solution | | |
| Water | 400 ml | 400 ml |
| Ammonium thiosulfate (70% soln.) | 100 ml | 120 ml |
| Ammonium sulfite | 20 g | 30 g |
| Ammonium iron (III) ethylenediaminetetraacetate | 40 g | 50 g |
| Disodium ethylenediamineeteraacetate | 5 g | 10 g |
| Halide | shown in Table 4 below | |
| Water to make | 1,000 ml | 1,000 ml |
| pH at 25° C. | 6.30 | 5.90 |

Rinse Solution

Ion exchange water (contents of calcium and magnesium each not more than 3 ppm).

Using the above described running solutions, exposed samples were processed in the same manner as described in Example 1, and amount of remaining silver, $D_{B\ min}$ and cyan color forming rate were determined. The results thus obtained are shown in Table 4 below.

TABLE 4

| No. | Benzyl Alcohol Tank Solution (ml) | Benzyl Alcohol Replenisher (ml) | Preservative | Amount Added (mol/l) | Halide | Amount Added (mol/l) | Amount of Remaining Silver (μg/cm²) | $D_B$ min | Cyan Color Forming Rate (%) | Remark |
|---|---|---|---|---|---|---|---|---|---|---|
| 1 | 15 | 20 | Sodium Sulfite | 0.02 | — | — | 12 | 0.15 | 91 | Comparison |
| 2 | — | — | Sodium Sulfite | " | $NH_4Br$ | 0.3 | 9 | 0.15 | 95 | " |
| 3 | — | — | — | — | — | — | 11 | 0.14 | 95 | " |
| 4 | 15 | 20 | — | — | $NH_4Br$ | 0.3 | 4 | 0.10 | 97 | This invention |
| 5 | — | — | — | — | " | " | 3 | 0.09 | 99 | This invention |
| 6 | — | — | VII-1 | 1.0 | " | " | 3 | 0.08 | 100 | This invention |
| 7 | — | — | XVI-7 | 1.0 | " | " | 3 | 0.08 | 100 | This invention |
| 8 | 15 | 20 | — | — | KI | $1 \times 10^{-3}$ | 5 | 0.10 | 97 | This invention |
| 9 | — | — | VII-1 | 1.0 | " | " | 3 | 0.08 | 100 | This invention |
| 10 | | | | | | | | | | |

From the results shown in Table 4 it is apparent that the method according to the present invention was excellent with respect to amount of remaining silver, $D_b$ min and color forming rate of cyan dye. Further, it was more effective when benzyl alcohol was absent (Nos. 5, 6, 7 and 9).

EXAMPLE 6

In the same manner as described in Example 5, exposed samples were processed except that Cyan coupler (ExC=2') shown below was used in the fifth layer in place of Cyan coupler (ExC-1'); the time for bleach-fixing in the running test was changed from 60 sec to 40 sec; and the amount of replenisher for Rinse (3) was changed from 250 ml to 300 ml. The amount of remaining silver, DB min and cyan color forming rate were determined. The results thus obtained are shown in Table 5 below.

Cyan Coupler (ExC-2')

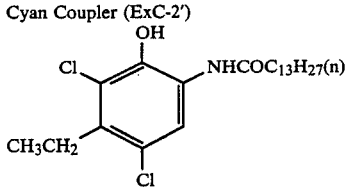

TABLE 5

| No. | Benzyl Alcohol Tank Solution (ml) | Benzyl Alcohol Replenisher (ml) | Preservative | Amount Added (mol/l) | Halide | Amount Added (mol/l) | Amount of Remaining Silver (μg/cm²) | $D_B$ min | Cyan Color Forming Rate (%) | Remark |
|---|---|---|---|---|---|---|---|---|---|---|
| 1 | 15 | 20 | Sodium Sulfite | 0.02 | — | — | 18 | 0.15 | 87 | Comparison |
| 2 | — | — | — | — | — | — | 17 | 0.15 | 89 | " |
| 3 | — | — | Sodium Sulfite | 0.02 | $NH_4Br$ | 0.2 | 12 | 0.13 | 92 | " |
| 4 | 15 | 20 | — | — | $NH_4Br$ | 0.2 | 6 | 0.10 | 95 | This invention |
| 5 | — | — | — | — | " | " | 4 | 0.09 | 99 | This invention |
| 6 | — | — | Triethanol-amine | 0.1 | " | " | 3 | 0.08 | 100 | This invention |
| 7 | — | — | DABCO | 0.1 | " | " | 3 | 0.08 | 100 | This invention |
| 8 | — | — | MeDABCO | 0.1 | " | " | 3 | 0.08 | 100 | This invention |
| 9 | 15 | 20 | MeDABCO | 0.1 | " | " | 6 | 0.10 | 97 | This invention |

From the results shown in Table 5 it is apparent that the method according to the present invention was excellent with respect to amount of remaining silver, $D_B$ min and color forming rate of cyan dye. Further, it was more effective when benzyl alcohol was absent (Nos. 5, 6, 7 and 8).

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising the steps of:

(a) developing an imagewise exposed silver halide color photographic material with a color developing solution substantially free from sulfite ions; and (b) immediately contacting the developed silver halide color photographic material with a bleach-fixing solution containing at least one of (i) from $1\times10^{-2}$ mol to 2 mol of bromide ions and (ii) from $5\times10^{-4}$ mol to $5\times10^{-2}$ mol of iodide ions per liter of said solution.

2. The method for processing a silver halide color photographic material as claimed in claim 1, wherein the bleach-fixing solution contains from $1\times10^{-2}$ mol to $5\times10^{-1}$ mol of bromide ions per liter.

3. The method for processing a silver halide color photographic material as claimed in claim 1, wherein the bleach-fixing solution contains from $5\times10^{-4}$ mol to $1\times10^{-2}$ mol of iodide ions per liter.

4. The method for processing a silver halide color photographic material as claimed in claim 1, wherein the color developing solution contains from 0 to 0.005 mol of sulfite ions per liter.

5. The method for processing a silver halide color photographic material as claimed in claim 1, wherein the color developing solution is substantially free from benzyl alcohol.

6. The method for processing a silver halide color photographic material as claimed in claim 5, wherein the color developing solution contains no added benzyl alcohol.

7. The method for processing a silver halide color photographic material as claimed in claim 1, wherein the color developing solution further contains an organic preservative.

8. The method for processing a silver halide color photographic material as claimed in claim 7, wherein the organic preservative is selected from a hydroxylamine, a hydroxamic acid, a hydrazine, a hydrazide, a phenol, an α-hydroxyketone, an α-aminoketone, a saccharide, a monoamine, a diamine, a polyamine, a quaternary ammonium salt, a nitroxy radical, an alcohol, an oxime, a diamide compound and a condensed ring amine.

9. The method for processing a silver halide color photographic material as claimed in claim 1, wherein the color developing solution contains from about 0.1 g/1 to 20 g/1 of an aromatic primary amine color developing agent.

10. The method for processing a silver halide color photographic material as claimed in claim 1, wherein the bleach-fixing solution contains from 0.01 mol/1 to 1.0 mol/1 of an organic complex salt of iron (III), and from 0.3 mol/1 to 2 mil/1 of a thiosulfate.

11. The method for processing a silver halide color photographic material as claimed in claim 1, wherein, after said contacting with a bleach-fixing solution, the color photographic material is subjected to at least one of a water washing step and a stabilizing step.

12. The method for processing a silver halide color photographic material as claimed in claim 1, wherein said material contains at least one cyan coupler represented by the following general formula (C):

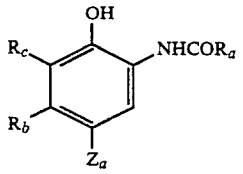

(C)

wherein $R_a$ represents a substituted or unsubstituted alkyl group, a substituted or unsubstituted cycloalkyl group, a substituted or unsubstituted aryl group, a substituted or unsubstituted amino group, or a substituted or unsubstituted heterocyclic group; $R_b$ represents a substituted or unsubstituted acylamino group or a substituted or unsubstituted alkyl group having at least 2 carbon atoms; $R_c$ represents hydrogen, a halogen atom, a substituted or unsubstituted alkyl group, or a substituted or unsubstituted alkoxy group; $R_b$ and $R_c$ may be linked to form a ring; and $Z_a$ represents hydrogen, a halogen atom, or a group capable of being released by a coupling reaction with the oxidation product of an aromatic primary amine color developing agent.

13. The method for processing a silver halide color photographic material as claimed in claim 12, wherein the amount of the cyan coupler represented by general formula (C) is $1\times10^{-6}$ mol to $1\times10^{-2}$ mol per $m^2$ of the photographic light-sensitive material.

14. The method for processing a silver halide color photographic material as claimed in claim 13, wherein the amount of the cyan coupler represented by general formula (C) is $1\times10^{-5}$ mol to $1\times10^{-3}$ mol per $m^2$ of the photographic light-sensitive material.

* * * * *